US011238786B2

(12) United States Patent
Byun et al.

(10) Patent No.: US 11,238,786 B2
(45) Date of Patent: Feb. 1, 2022

(54) DRIVING METHOD FOR LIGHT EMITTING DISPLAY DEVICE

(71) Applicant: Samsung Display Co., Ltd., Yongin-Si (KR)

(72) Inventors: Min Woo Byun, Seongnam-si (KR); Kyoung Jin Park, Hwaseong-si (KR); Jong Won Park, Yongin-si (KR); Myeong Hee Seo, Hwaseong-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/133,391

(22) Filed: Dec. 23, 2020

(65) Prior Publication Data

US 2021/0350740 A1 Nov. 11, 2021

(30) Foreign Application Priority Data

May 8, 2020 (KR) ..... 10-2020-0055184

(51) Int. Cl.
*G09G 3/32* (2016.01)

(52) U.S. Cl.
CPC ..... *G09G 3/32* (2013.01); *G09G 2310/0267* (2013.01); *G09G 2310/0275* (2013.01)

(58) Field of Classification Search
CPC ..... G09G 3/32; G09G 2310/0275; G09G 2310/0267
See application file for complete search history.

(56) References Cited

U.S. PATENT DOCUMENTS

2014/0333686 A1* 11/2014 Kim ..... G09G 3/3233 345/694
2016/0163243 A1* 6/2016 Park ..... G09G 3/3258 345/205
2016/0321994 A1* 11/2016 Lee ..... G09G 3/2003
2017/0039936 A1* 2/2017 Byun ..... G09G 3/3225
2017/0053591 A1* 2/2017 Seo ..... G09G 3/3225
2017/0116922 A1* 4/2017 Jung ..... G09G 3/3258
2017/0140706 A1* 5/2017 Song ..... G09G 3/3233
2018/0197481 A1* 7/2018 Choi ..... G09G 3/3266
2018/0293938 A1* 10/2018 Kim ..... G09G 3/3225

FOREIGN PATENT DOCUMENTS

KR 10-2012-0065137 A 6/2012
KR 10-2014-0013586 A 2/2014
KR 10-1413198 B1 6/2014

* cited by examiner

*Primary Examiner* — Ibrahim A Khan
(74) *Attorney, Agent, or Firm* — Innovation Counsel LLP

(57) ABSTRACT

A display device includes the following elements: a light emitting diode; a first transistor including a drain electrode, a source electrode, and a gate electrode, the drain electrode being connected to the light emitting diode; a second transistor connected between a data line and the source electrode; a third transistor connected between the drain electrode and the gate electrode; and a fourth transistor connected between a first initialization voltage source and the gate electrode. The third transistor is off for a first period, on for a second period immediately following the first period, and off for a third period immediately following the second period. The fourth transistor is off for a fourth period, on for a fifth period immediately following the fourth period, and off for a sixth period immediately following the fifth period. The second period overlaps the fifth period.

20 Claims, 16 Drawing Sheets

DRIVING METHOD FOR LIGHT EMITTING DISPLAY DEVICE

CROSS-REFERENCE TO RELATED APPLICATION

This application claims priority to and the benefit of Korean Patent Application No. 10-2020-0055184 filed in the Korean Intellectual Property Office on May 8, 2020; the Korean Patent Application is incorporated herein by reference.

BACKGROUND

1. Field

The technical field relates to a light emitting display device and a driving method of the light emitting display device.

2. Description of the Related Art

A display device may be, for example, a liquid crystal display (LCD) or an organic light emitting diode (OLED) display. Display devices may be used in various electronic devices, such as portable telephones, navigation systems, digital cameras, electronic books, portable game machines, and various terminals.

A display device may include pixels disposed in rows and columns. A pixel may include transistors and capacitors. The display device may include wires that can transmit signals to these transistors and capacitors. The display device may display images according to the signals.

The Background section is for enhancement of understanding of the background of the described technology. The Background section may contain information that does not form the prior art.

SUMMARY

Embodiments may be related a light emitting display device that allows a predetermined voltage to be maintained substantially constant. Embodiments may be related to a driving method of the light emitting display device.

A light emitting display device according to an embodiment includes: a light emitting diode; a driving transistor that transmits an output current to the light emitting diode; a second transistor that transmits a data voltage to a source electrode of the driving transistor; a third transistor that connects a drain electrode and a gate electrode of the driving transistor; a fourth transistor that initializes the gate electrode of the driving transistor with a first initialization voltage; and an eighth transistor that applies a bias voltage to the source electrode of the driving transistor, wherein a section during which the third transistor is turned on and thus the drain electrode and the gate electrode of the driving transistor are connected, and a section during which the fourth transistor is turned on and thus a voltage of the gate electrode of the driving transistor is changed to the first initialization voltage, are at least partially overlapped with each other.

The third transistor may be turned on after a section during which the light emitting diode emits light is terminated and odd-numbered 1Hs are passed.

The fourth transistor may be turned on after the section during which the light emitting diode emits light is terminated and odd-numbered 1Hs are passed.

The second transistor is turned on when the fourth transistor may be in the turned-off state and the third transistor is in the turned-on state, and a state in which the fourth transistor is in the turned-off state and the third transistor is in the turned-on state is called a writing available section, the writing available section includes a plurality of unit application sections, and the plurality of unit application sections include a first application section during which the second transistor is turned on and a second application section during which the second transistor is not turned on.

The second application section may be a section during which an initialization control signal that controls the fourth transistor is floated.

When a frequency at which the eighth transistor is turned on is called a first frequency and a frequency at which the third transistor and the fourth transistor are turned on is called a second frequency, the first frequency may be higher than the second frequency.

The light emitting display device may further include: a first scan line that is connected with a gate electrode of the second transistor; a second scan line that is connected with a gate electrode of the third transistor; an initialization control line that is connected with a gate electrode of the fourth transistor; and a bias control line that is connected with a gate electrode of the eighth transistor, wherein the second scan line, the initialization control line, and the bias control line are connected to pixels of two rows together, and the first scan line is formed in pixels of every single row.

The light emitting display device may further include: a fifth transistor that transmits a driving voltage to the source electrode of the driving transistor; a sixth transistor that connects the drain electrode of the driving transistor and an anode of the light emitting diode to each other; a seventh transistor that initializes a voltage of the anode of the light emitting diode to a second initialization voltage; and a light emission control line that is connected with a gate of the fifth transistor and a gate electrode of the sixth transistor, wherein a gate electrode of the seventh transistor may be connected with the bias control line.

A driving method of a light emitting display device according to an embodiment includes: a light emitting section during which a driving transistor transmits an output current to a light emitting diode and thus the light emitting diode emits light; a pre-bias section during which a bias voltage is applied to a source electrode of the driving transistor; an anode reset section during which an anode of the light emitting diode is initialized; a gate initialization section during which a gate electrode of the driving transistor is initialized; a drain initialization section during which a drain electrode of the driving transistor is initialized; and a threshold voltage compensation and data writing section during which a threshold voltage of the driving transistor is compensated and a data voltage is written, wherein the drain initialization section starts after the light emitting section is terminated and odd-numbered 1Hs are passed.

The gate initialization section may start after the light emitting section is terminated and odd-numbered 1Hs are passed.

The drain initialization section and the gate initialization section may be at least partially overlapped with each other.

The drain initialization section and the gate initialization section may start with the same timing.

When a section after the gate initialization section is terminated while the drain initialization section is in progress is called a writing available section, the writing available section includes a plurality of unit application sections, and the plurality of unit application sections include a first application section in which the threshold voltage compensation and data writing section is provided and a second application section in which the threshold voltage compensation and data writing section is not provided, and thus the threshold voltage compensation and data writing section is provided in one 1H of the first application section.

The second application section may be a section during which an initialization control signal that controls the gate initialization section is floated.

when a frequency at which the light emitting section, the pre-bias section, and the anode reset section are iterative positioned is called a first frequency and a frequency at which the gate initialization section, the drain initialization section, and the threshold voltage compensation and data writing section are iteratively positioned is called a second frequency, the first frequency may be higher than the second frequency.

A driving method of a light emitting display device according to embodiment includes: a light emitting section during which a driving transistor transmits an output current to a light emitting diode and thus the light emitting diode emits light; a pre-bias section during which a bias voltage is applied to a source electrode of the driving transistor; an anode reset section during which an anode of the light emitting diode is initialized; a gate initialization section during which a gate electrode of the driving transistor is initialized; a drain initialization section during which a drain electrode of the driving transistor is initialized; and a writing available section that includes a threshold voltage compensation and data writing section during which a threshold voltage of the driving transistor is compensated and a data voltage is written, wherein the writing available section includes a plurality of unit application section, the plurality of unit application sections are divided into a first application section and a second application section, and the threshold voltage compensation and data writing section is positioned in the first application section.

The second application section may be a section during which an initialization control signal that controls the gate initialization section is floated.

The drain initialization section or the gate initialization section may start after the light emitting section is terminated and odd-numbered 1Hs are passed.

The drain initialization section and the gate initialization section may be at least partially overlapped with each other.

When a frequency at which the light emitting section, the pre-bias section, and the anode reset section are iterative positioned is called a first frequency and a frequency at which the gate initialization section, the drain initialization section, and the threshold voltage compensation and data writing section are iteratively positioned is called a second frequency, the first frequency may be higher than the second frequency.

An embodiment may be related to a display device. The display device may include the following elements: a light emitting diode; a first transistor, wherein a drain electrode of the first transistor may be electrically connected to the light emitting diode and may be connected between the light emitting diode and a source electrode of the first transistor; a data line for transmitting a data voltage; a second transistor electrically connected between the data line and the source electrode of the first transistor; a third transistor electrically connected between the drain electrode of the first transistor and a gate electrode of the first transistor; and a fourth transistor electrically connected between a first initialization voltage source and the gate electrode of the first transistor for initializing the gate electrode of the first transistor with a first initialization voltage. The third transistor may be off for a first period, may be on for a second period immediately following the first period, and may be off for a third period immediately following the second period. The fourth transistor may be off for a fourth period, may be on for a fifth period immediately following the fourth period, and may be off for a sixth period immediately following the fifth period. The second period may overlap the fifth period.

The light emitting diode may emit light for a seventh period. An odd number of scan-signal lengths may immediately follow the seventh period and may immediately precede the second period.

The odd number of scan-signal lengths may immediately follow the seventh period and may immediately precede the fifth period.

A writing available period may overlap each of the second period and the sixth period, may include a first application period, and may include a second application period immediately following the first application period. The second transistor may be on for the first application period and may be off for the second application period.

A gate electrode of the fourth transistor may receive an initialization control signal. The initialization control signal may control the fourth transistor. The initialization control signal may be floating for the second application period.

The display device may include a bias-voltage transistor. A drain electrode of the bias-voltage transistor may be electrically connected to the source electrode of the first transistor. A source electrode of the bias-voltage transistor may be electrically connected to a bias-voltage source. The bias-voltage transistor may be turned on according to a first frequency. Each of the third transistor and the fourth transistor may be turned on according to a second frequency. The first frequency may be higher than the second frequency.

The display device may include the following elements: a first scan line electrically connected to a gate electrode of the second transistor; a second scan line electrically connected to a gate electrode of the third transistor; an initialization control line electrically connected to a gate electrode of the fourth transistor; a bias-voltage transistor, wherein a drain electrode of the bias-voltage transistor may be electrically connected to the source electrode of the first transistor, and wherein a source electrode of the bias-voltage transistor may be electrically connected to a bias-voltage source; and a bias control line electrically connected to a gate electrode of the bias-voltage transistor. Each of the second scan line, the initialization control line, and the bias control line may be electrically connected to pixels of two pixel rows. The first scan line may be electrically connected to pixels of exactly one of the two pixel rows.

The display device may include the following elements: a fifth transistor, wherein a source electrode of the fifth transistor may be electrically connected to a driving-voltage source, and wherein a drain electrode of the fifth transistor may be electrically connected to the source electrode of the first transistor; a sixth transistor, wherein a source electrode of the sixth transistor may be electrically connected to the drain electrode of the first transistor, and wherein a drain electrode of the sixth transistor may be electrically connected to an anode of the light emitting diode; a seventh transistor for initializing a voltage of the anode of the light emitting diode to a second initialization voltage, wherein a source electrode of the seventh transistor may be electrically connected to a second initialization voltage source, and wherein a drain electrode of the seventh transistor may be electrically connected to the anode of the light emitting diode; and a light emission control line electrically connected to each of a gate of the fifth transistor and a gate electrode of the sixth transistor. A gate electrode of the seventh transistor may be electrically connected to the bias control line.

An embodiment may be related to a method of operating a display device that includes a driving transistor, a light emitting diode, and a storage capacitor. The method may include the following steps: throughout a light emitting period, transmitting an output current through the driving transistor to the light emitting diode for the light emitting diode to emit light; throughout a pre-bias period, applying a bias voltage to a source electrode of the driving transistor; throughout an anode reset period, initializing an anode of the light emitting diode; throughout a gate initialization period, initializing a gate electrode of the driving transistor; throughout a drain initialization period, initializing a drain electrode of the driving transistor; and throughout a threshold voltage compensation and data writing period, compensating for a threshold voltage of the driving transistor, and writing a data voltage to the storage capacitor. An odd number of scan-signal lengths may immediately follow the light emitting period and may immediately precede the drain initialization period.

The odd number of scan-signal lengths may immediately follow the light emitting period and may immediately precede the gate initialization period.

The drain initialization period and the gate initialization period at least partially overlap each other.

The drain initialization period and the gate initialization period may start simultaneously.

A writing available period may start after the gate initialization period has ended, may overlap the drain initialization period, may include a first application period, and may include a second application period. The compensating and the writing may be performed for the first application period and not for the second application period. The threshold voltage compensation and data writing period may be equivalent to one scan-signal length within the first application period.

The method may include providing an initialization control signal in the gate initialization period for controlling initialization of the gate electrode of the first transistor. The initialization control signal may be floating for the second application period.

The light emitting period, the pre-bias period, and the anode reset period may repeat according to a first frequency. The gate initialization period, the drain initialization period, and the threshold voltage compensation and data writing period may repeat according to a second frequency. The first frequency may be higher than the second frequency.

An embodiment may be related to a method of operating a display device that includes a driving transistor, a light emitting diode, and a storage capacitor. The method may include the following steps: throughout a light emitting period, transmitting an output current through the driving transistor to the light emitting diode for the light emitting diode to emit light; throughout a pre-bias period, applying a bias voltage to a source electrode of the driving transistor; throughout an anode reset period, initializing an anode of the light emitting diode; throughout a gate initialization period, initializing a gate electrode of the driving transistor; throughout a drain initialization period, initializing a drain electrode of the driving transistor; and throughout a threshold voltage compensation and data writing period, compensating for a threshold voltage of the driving transistor, and writing a data voltage to the storage capacitor. A writing available period may include a first application period and a second application period. The threshold voltage compensation and data writing period may be within the first application period.

The method may include providing an initialization control signal in the gate initialization period for controlling initialization of the gate electrode of the first transistor. The initialization control signal may be floating for the second application period.

An odd number of scan-signal lengths may immediately precede the drain initialization period or the gate initialization period and may immediately follow the light emitting period.

The drain initialization period and the gate initialization period may at least partially overlap each other.

The pre-bias period, and the anode reset period may repeat according to a first frequency. The gate initialization period, the drain initialization period, and the threshold voltage compensation and data writing period may repeat according to a second frequency. The first frequency may be higher than the second frequency.

According to embodiments, a voltage (e.g., a first initialization voltage applied to a gate electrode of a driving transistor) of an element in a pixel is maintained substantially constant, and/or a voltage level of a signal (e.g., a scan signal or an initialization control signal) applied to the pixel is maintained substantially constant, such that desired luminance of the pixel can be stably displayed.

DETAILED DESCRIPTION

Figure 1:
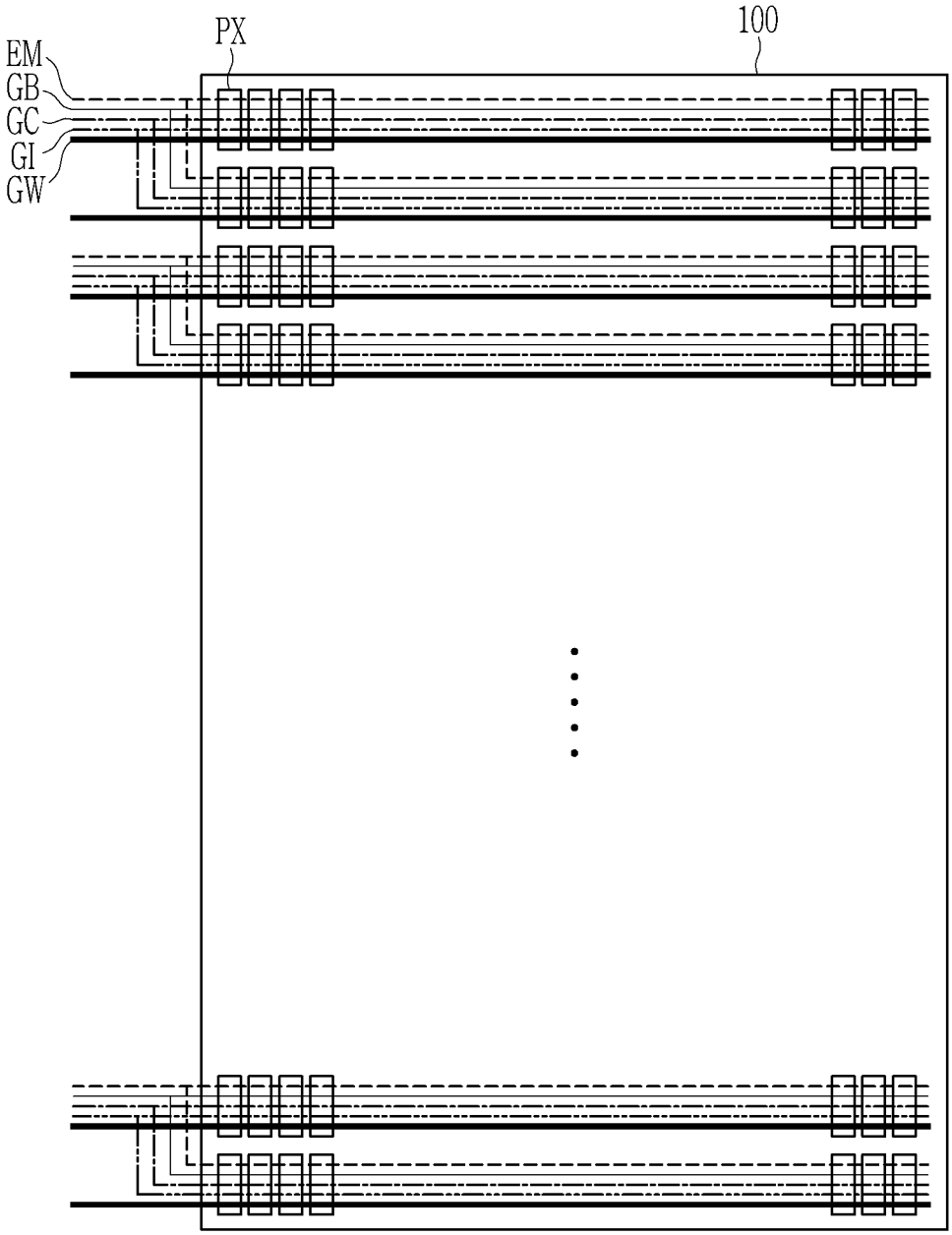
FIG. 1 is a schematic diagram of a light emitting display device according to an embodiment.

Example embodiments are described with reference to the accompanying drawings. The described embodiments may be modified in various ways.

The same reference numerals may designate like or similar elements.

In the drawings, dimensions of elements may be exaggerated for clarity.

Although the terms "first," "second," etc. may be used to describe various elements, these elements should not be limited by these terms. These terms may be used to distinguish one element from another element. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set)," "second-type (or second-set)," etc., respectively.

The term "section" may mean "period." The term "floated" may mean "floating." The term "connect" may mean "electrically connect" or "electrically connected through no intervening transistor." The term "drive" may mean "operate" or "control." The term "connected with" may mean "connected to." The expression "be formed of" may mean "consist of." The term "compensate" may mean "compensate for." The term "for" or "during" may mean "throughout." The expression "be passed" may mean "pass" or "elapse." The expression "be overlapped with" may mean "overlap." The expression "be terminated" may mean "end." The expression "odd-numbered 1Hs" may mean "an odd number of scan-signal lengths (1Hs)."

FIG. 1 is a schematic diagram of a light emitting display device according to an embodiment.

The light emitting display device includes a plurality of pixels PX.

Each pixel PX included in the light emitting display device includes a driving circuit portion and a light emitting element portion. The light emitting element portion includes a light emitting diode and may include a capacitor depending on embodiments, and the driving circuit portion may include a plurality of transistors and a capacitor. The driving circuit portion is formed on a substrate, and then the light emitting element portion may be disposed thereon.

In the pixel PX shown in FIG. 1, the driving circuit portion has a rectangular shape and may be arranged in a matrix format along rows and columns.

The light emitting element portion of the pixel PX is formed on the driving circuit portion, and includes a rectangular shaped structure, and may be formed in various structures such as a circle and a rhombus. The light emitting element portion may not be arranged in a matrix format, but may be disposed in various arrangements.

In the embodiment of FIG. 1, pixels PX of two rows receive instances of at least one signal.

In FIG. 1, a light emission control line EM, a bias control line GB, a second scan line GC, and an initialization control line GI are shared by two pixel rows; a first scan line GW is provided for each pixel row. Wires (a light emission control line EM, a bias control line GB, a second scan line GC, and an initialization control line GI) connected together to pixels PX of two rows are referred to as common connection wires.

When a common connection wire is formed, the number of wires in an area (i.e., a display area) where the pixels PX are located is reduced, thereby forming the pixels with high resolution. The area of a non-display area, which is outside the display area, can also be reduced.

On the other hand, when using a common wire, the wire receiving each signal is not directly applied with a constant voltage for one frame, but a constant level of voltage may be applied through repetition of the timing at which the signal is directly applied and the timing at which the existing voltage is maintained by floating.

The pixel PX additionally receives a data voltage, a driving voltage, an initialization voltage, and a bias voltage.

Figure 2:
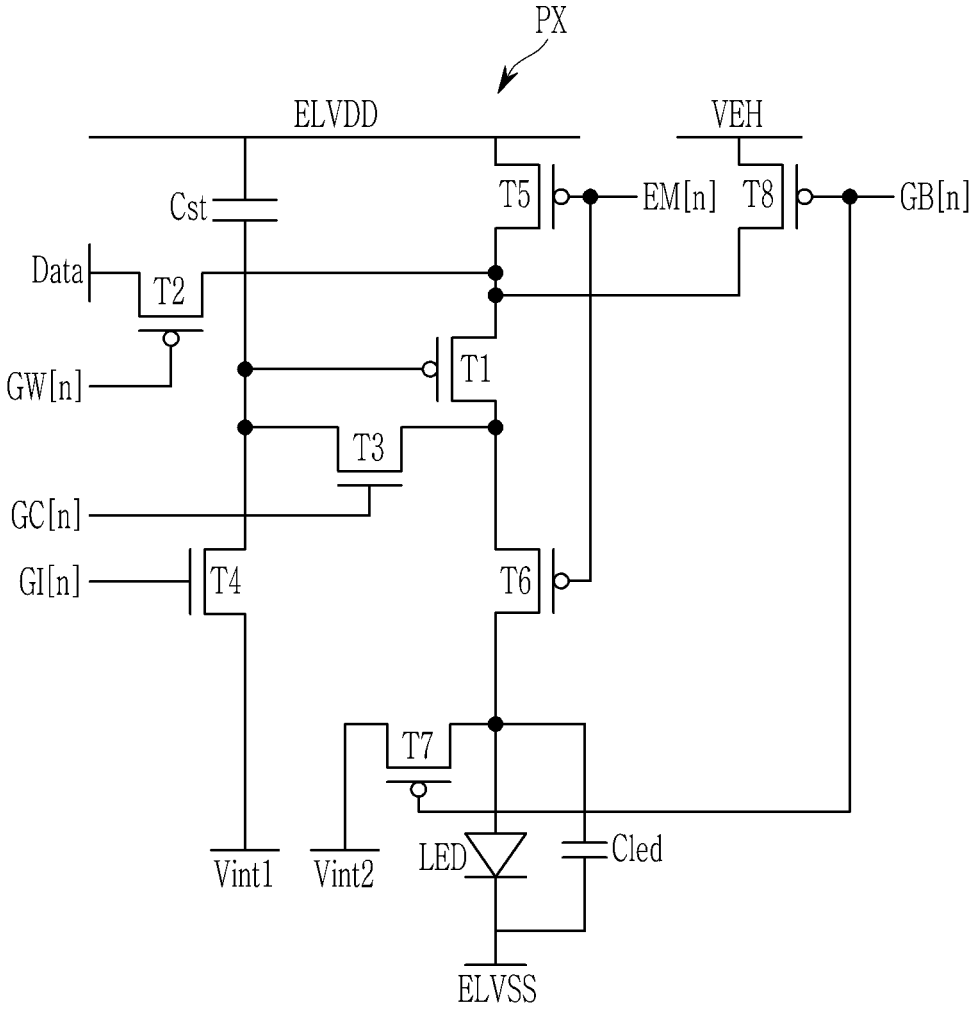
FIG. 2 is a circuit diagram of a pixel of the light emitting display device according to an embodiment.

FIG. 2 is a circuit diagram of a pixel of the light emitting display device according to the embodiment.

A pixel PX formed in the light emitting display device includes transistors T1, T2, T3, T4, T5, T6, T7, and T8, capacitors Cst and Cled, and a light emitting diode LED connected to signal lines. The driving circuit portion includes the plurality of transistors T1, T2, T3, T4, T5, T6, T7, and T8 and the storage capacitor Cst, and the light emitting element portion includes the light emitting diode LED, and the capacitor Cled for a light emitting diode.

The signal lines connected to one pixel PX include a first scan line GW, a second scan line GC, an initialization control line GI, a bias control line GB, a light emission control line EM, a data line, a first initialization voltage line, a second initialization voltage line, a bias voltage line, a driving voltage line, and a driving low voltage line.

The first scan line GW transmits a first scan signal GW[n] to a gate electrode of the second transistor T2 of the pixel PX, and one first scan line GW is formed in each pixel row.

The second scan line GC transmits a second scan signal GC[n] to a gate electrode of the third transistor T3 of the pixel PX, and is one of the common connection wires because it is formed for every two pixel rows.

The initialization control line GI transmits an initialization control signal GI[n] to a gate electrode of the fourth transistor T4 of the pixel PX, and is one of the common connection wires because it is formed form for every two pixel rows.

The bias control line GB transmits a bias control signal GB[n] to a gate electrode of the seventh transistor T7 and a gate electrode of the eighth transistor T8 of the pixel PX, and is one of the common connection wires because it is formed for every two pixel rows.

The light emission control line EM transmits a light emission control signal EM[n] to a gate electrode of the fifth transistor T5 and a gate electrode of the sixth transistor T6 of the pixel PX, and is one of the common connection wires because it is formed for every two pixel rows.

The data line transmits a data voltage Data to a first electrode of the second transistor T2 of the pixel PX, and is formed for the corresponding pixel column.

The first initialization voltage line transmits a first initialization voltage Vint1 to a first electrode of the fourth transistor T4 of the pixel PX, and applies the first initialization voltage Vint1 of a constant level to all the pixels PX. Depending on embodiments, the first initialization voltage line may have a mesh structure that is connected in the row direction and the column direction.

The second initialization voltage line transmits a second initialization voltage Vint2 to a first electrode of the seventh transistor T7 of the pixel PX, and applies the second initialization voltage Vint2 of a constant level to all the pixels PX. The second initialization voltage Vint2 has a lower level than the first initialization voltage Vint1. In addition, depending on embodiments, the second initialization voltage line may have a mesh structure that is connected in the row direction and the column direction.

The bias voltage line transmits a bias voltage VEH to a first electrode of the eighth transistor T8 of the pixel PX, and the bias voltage VEH may have a constant level or may have a level that is changed according to the bias control signal GB[n] depending on embodiments. When the bias voltage VEH is constant, the bias voltage line can be connected to all the pixels PX. However, when the bias voltage VEH is changed, a separate bias voltage line may be formed for each pixel column or pixel row, or one bias voltage line may be formed for a plurality of pixel columns or a plurality of pixel rows.

The driving voltage line transmits a driving voltage ELVDD to a first electrode of the fifth transistor T5 and one end of the storage capacitor Cst of the pixel PX, and applies a driving voltage ELVDD of a constant high voltage level to all the pixels PX. Depending on embodiments, the driving voltage line may have a mesh structure connected to a row direction and a column direction.

The driving low voltage line transmits a driving low voltage ELVSS to a cathode of the light emitting diode LED of the pixel and one end of the capacitor Cled for the light emitting diode, and applies the driving low voltage ELVSS of a constant low voltage level to all the pixels PX. Depending on embodiments, the driving low voltage line may have a mesh structure connected in a row direction and a column direction.

The driving transistor T1 (also referred to as a first transistor) may have a P-type transistor characteristic, and may include a polycrystalline semiconductor. The driving transistor T1 receives a data voltage Data from the second transistor T2, and outputs an output current according to the magnitude of the data voltage Data during a light emission section. The output current is transmitted to an anode of the light emitting diode LED such that the light emitting diode LED emits light. A source electrode of the driving transistor T1 is connected with a second electrode of the second transistor T2 and thus receives the data voltage Data, and a drain electrode of the driving transistor T1 outputs an output current and a gate electrode of the driving transistor T1 is connected with one electrode of the storage capacitor Cst.

The storage capacitor Cst serves to maintain a voltage of the gate electrode of the driving transistor T1 for one frame or longer, and one electrode is connected with the gate electrode of the driving transistor T1 and the other electrode is connected with the driving voltage line and thus receives a constant driving voltage ELVDD.

The second transistor T2 may have a P-type transistor characteristic, and may include a polycrystalline semiconductor. The second transistor T2 serves to receive the data voltage Data in the pixel PX. A gate electrode of the second transistor T2 is connected to the first scan line GW, a first electrode of the second transistor T2 is connected with the data line, and a second electrode of the second transistor T2 is connected with the source electrode of the driving transistor T1. When the first scan signal GW[n] transmitted through the first scan line GW is low level, the second transistor T2 is turned on and the data voltage Data transmitted through the data line at this point is transmitted to the source electrode of the driving transistor T1.

The third transistor T3 may have an N-type transistor characteristic, and may include an oxide semiconductor. The third transistor T3 electrically connects the drain electrode of the driving transistor T1 and the gate electrode of the driving transistor T1 such that the driving transistor T1 has a diode-connection structure, and the data voltage Data transmitted to the source electrode of the driving transistor T1 is transmitted to the gate electrode (i.e., one electrode of the sustain electrode Cst) of the driving transistor T1. A gate electrode of the third transistor T3 is connected with the second scan line GC, a first electrode of the third transistor T3 is connected with the drain electrode of the driving transistor T1, and a second electrode of the third transistor T3 is connected with one electrode of the storage capacitor Cst and the gate electrode of the driving transistor T1. When the second scan signal GC[n] transmitted through the second scan line GC is high level, the third transistor T3 is turned on and thus the gate electrode and the drain electrode of the driving transistor T1 are connected, and transmits the data voltage Data applied to the source electrode of the driving transistor T1 to one electrode of the storage capacitor Cst and the data voltage Data is stored in the storage capacitor Cst.

The fourth transistor T4 may have an N-type transistor characteristic, and may include an oxide semiconductor. The fourth transistor T4 serves to initialize the gate electrode of the driving transistor T1 and one electrode of the storage capacitor Cst with the first initialization voltage Vint1. A gate electrode of the fourth transistor T4 is connected with the initialization control line GI, a first electrode of the fourth transistor T4 is connected with the first initialization voltage line, and a second electrode of the fourth transistor T4 are connected with the second electrode of the third transistor T3, one electrode of the storage capacitor Cst, and the gate electrode of the driving transistor T1. When the initialization control signal GI[n] transmitted through the initialization control line GI is high level, the fourth transistor T4 is turned on and thus the first initialization voltage Vint1 is transmitted to the gate electrode of the driving transistor T1 and the storage capacitor Cst. Accordingly, the voltage of the gate electrode of the driving transistor T1 and the voltage of one electrode of the storage capacitor Cst are initialized to the first initialization voltage Vint1.

The fifth transistor T5 may have a P-type transistor characteristic, and may include a polycrystalline semiconductor. The fifth transistor T5 serves to transmit the driving voltage ELVDD to the source electrode of the driving transistor T1. The gate electrode of the fifth transistor T5 is connected with the light emission control line EM, a first electrode of the fifth transistor T5 is connected with the driving voltage line, and a second electrode of the fifth transistor T5 is connected with the first electrode of the driving transistor T1. When the light emission control signal EM[n] transmitted through the light emission control line EM is low level, the fifth transistor T5 is turned on and transmits the driving voltage ELVDD to the source electrode of the driving transistor T1.

The sixth transistor T6 may have a P-type transistor characteristic, and may include a polycrystalline semiconductor. The sixth transistor T6 serves to transmit an output current output from the driving transistor T1 to the anode of the light emitting diode LED. A gate electrode of the sixth transistor T6 is connected with the light emission control line EM, a first electrode of the sixth transistor T6 is connected to the drain electrode of the driving transistor T1, and a second electrode is connected with the anode of the light emitting diode LED. When the light emission control signal EM[n] transmitted through the light emission control line EM is low level, the sixth transistor T6 is turned on and transmits the output current of the driving transistor T1 to the anode of the light emitting diode LED.

The seventh transistor T7 may have a P-type transistor characteristic, and may include a polycrystalline semiconductor. The seventh transistor T7 serves to initialize the anode of the light emitting diode LED with the second initialization voltage Vint2. A gate electrode of the seventh transistor T7 is connected with the bias control line GB, a first electrode of the seventh transistor T7 is connected with the anode of the light emitting diode LED, and a second electrode of the seventh transistor T7 is connected with the second initialization voltage line. When the bias signal GB[n] is low level, the seventh transistor T7 is turned on such that the second initialization voltage Vint2 is applied to the anode of the light emitting diode LED, and thus the anode of the light emitting diode LED is initialized.

The eighth transistor T8 may have a P-type transistor characteristic, and may include a polycrystalline semiconductor. The eighth transistor T8 serves to apply a bias voltage VEH to the first electrode of the driving transistor T1. A gate electrode of the eighth transistor T8 is connected with the bias control line GB, a first electrode of the eighth transistor T8 is connected with the bias voltage line, and a second electrode of the eighth transistor T8 is connected with the source electrode of the driving transistor T1. When the bias signal GB[n] is low level, the eighth transistor T8 is turned on and thus the bias voltage VEH is applied to the source electrode of the driving transistor T1.

The light emitting diode LED includes an anode, a cathode, and an intervening emission layer. The anode is connected to the second electrode of the sixth transistor T6 and the first electrode of the seventh transistor T7, and the cathode receives the driving low voltage ELVSS. When the output current of the driving transistor T1 is transmitted to the anode, the output current passes through the emission layer and is then transmitted to the cathode such that the emission layer emits light. In this case, when the intensity of the output current is increased, luminance of light emitted from the light emitting diode LED is increased. Depending on embodiments, the emission layer may display one of primary colors, and may include a quantum dot (QD) material. Depending on embodiments, the light emitting display device may further include a color reproduction layer including a color filter or a quantum dot (QD) material to display an improved color sense.

A capacitor Cled for a light emitting diode, including an anode and a cathode, may be additionally formed near the light emitting diode LED. The capacitor Cled for the light emitting diode includes an anode, a cathode, and an insulation layer that is disposed between the anode and the cathode, and serves to assist a voltage of the anode voltage to be kept constant over one frame.

One pixel PX of a light emitting display panel may include a light emitting diode LED, a driving transistor T1 transmitting an output current to the light emitting diode LED, a second transistor T2 transmitting a data voltage to a source electrode of the driving transistor T1, a third transistor T3 connecting the drain electrode and the gate electrode of the driving transistor T1, a fourth transistor T4 initializing the gate electrode of the driving transistor T1 to a first initialization voltage, and an eighth transistor T8 applying a bias voltage to the source electrode of the driving transistor T1.

A first scan line GW connected with the gate electrode of the second transistor T2, a second scan line GC connected with the gate electrode of the third transistor T3, an initialization control line GI connected with the gate electrode of the fourth transistor T4, and a bias control line GB connected with the gate electrode of the eighth transistor T8 are formed, and the second scan line GC, the initialization control line GI, and the bias control line GB are common connection wires that are connected together to pixels of every two rows, and the first scan line GW may be formed in pixels of every single row.

The pixel PX may further include a fifth transistor T5 transmitting a driving voltage to the source electrode of the driving transistor T1, a sixth transistor T6 connecting the drain electrode of the driving transistor T1 and the anode of the light emitting diode LED, a seventh transistor T7 initializing the anode of the light emitting diode LED by applying the second initialization voltage Vint2 thereto, and a light emission control line EM connected with the gate electrode of the fifth transistor T5 and the gate electrode of the sixth transistor T6. The gate electrode of the seventh transistor T7 may be connected with the bias control line GB.

The number of transistors, the number of capacitors, and the connection relations in a pixel may be configured according to embodiments. The gate electrode of the driving transistor T1 and the first scan line GW may further include an additional capacitor (also called a boost capacitor) and may partially overlap each other.

The driving transistor T1 may include a polycrystalline semiconductor in the embodiment shown in FIG. 2. The third transistor T3 and the fourth transistor T4 may include an oxide semiconductor. The second transistor T2, the fifth transistor T5, the sixth transistor T6, the seventh transistor T7, and the eighth transistor T8 may include a polycrystalline semiconductor. At least one of the second transistor T2, the fifth transistor T5, the sixth transistor T6, the seventh transistor T7, and the eighth transistor T8 may include an oxide semiconductor. The third transistor T3 and the fourth transistor T4 include a semiconductor material that is different from that of the driving transistor T1 such that more stable and reliable driving can be achieved.

Figure 3:
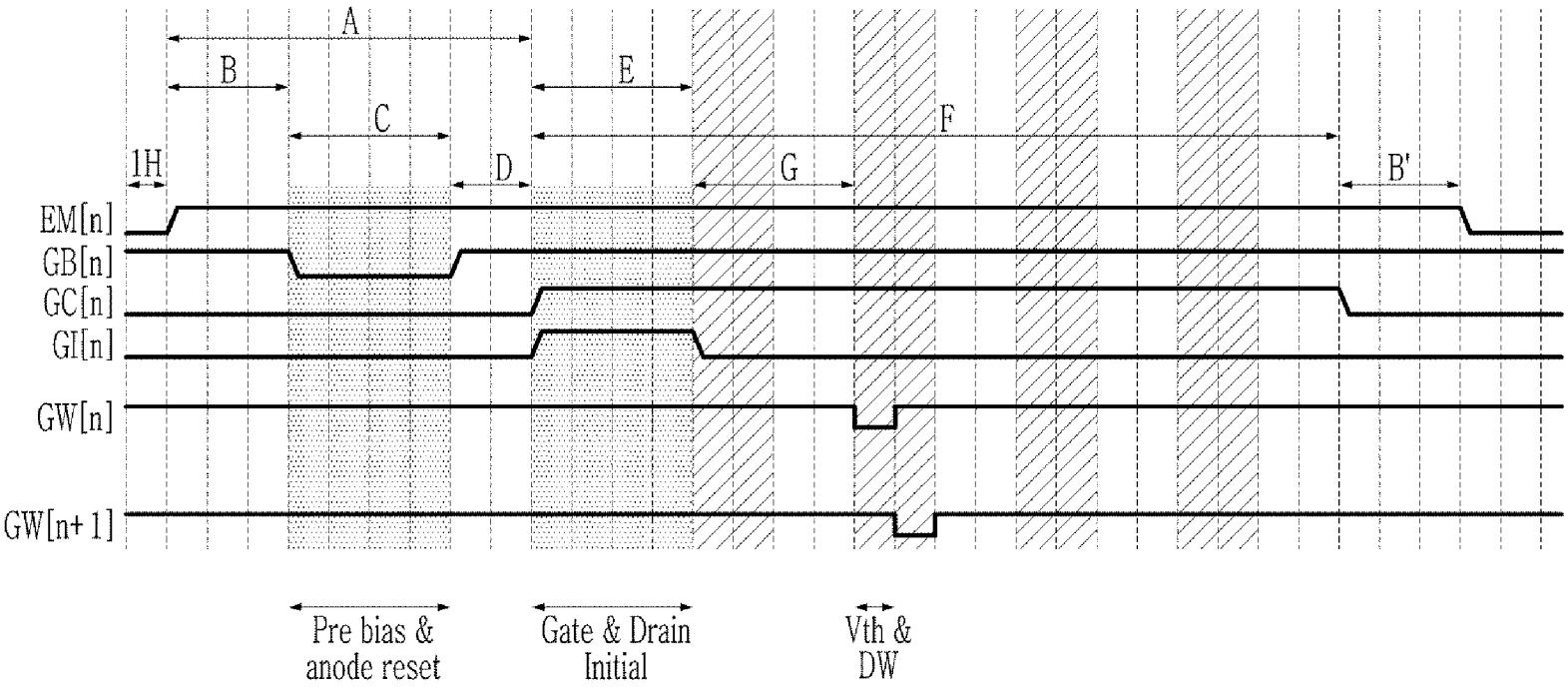
FIG. 3 is a waveform diagram of signals applied to the pixel of FIG. 2 according to an embodiment.

The pixel PX of the light emitting display device having the structure such as FIG. 1 and FIG. 2 may be applied with a signal shown in FIG. 3.

FIG. 3 is a waveform diagram of signals applied to the pixel of FIG. 2 according to an embodiment.

A light emission section is terminated when the light emission control signal EM[n] is changed to high level.

After termination of the light emission section, the bias control signal GB[n] is changed to low level after passing through the section B such that a pre-bias and anode reset section starts. The section B includes a plurality of odd-numbered sections H1, and in the embodiment of FIG. 3, the section B includes three of H1. 1H (i.e., 1 scan-signal length) is a time period/length for which the first scan signal GW[n] transmitted through the first scan line GW maintains the low level, and is a time period/length for the data voltage Data to be written into pixels of one row (corresponding to a threshold voltage compensation and data writing section, Vth & DW in FIG. 3). The pre-bias and anode reset section is carried out during the section C, and is carried out for four of H1 in the embodiment of FIG. 3.

The pre-bias and anode reset section includes a pre-bias section and an anode reset section.

As the bias control signal GB[n] is changed to low level, the eighth transistor T8 received the low-level bias control signal GB[n] is turned on. Thus, the bias voltage VEH is transmitted to the source electrode of the driving transistor T1 and thus the transistor T1 is changed to a bias voltage that is appropriate for subsequent operations. This will be called pre-bias, and a timing section during which the pre-bias is carried out is called a pre-bias section.

During the anode reset section, a bias control signal GB[n] is changed to low level and the seventh transistor T7 having received the low-level bias control signal GB[n] is turned on, and thus the second initialization voltage Vint2 is transmitted to the node of the light emitting diode LED such that the voltage of the anode of the light emitting diode LED is initialized to the second initialization voltage Vint2. A timing section during which such an anode reset operation is carried out is called the anode reset section.

The pre-bias section and the anode reset section are simultaneously carried out by the same signal (i.e., a bias control signal GB[n]). In embodiments, the pre-bias section and the anode reset section may be positioned at different sections, or may only be partially overlapped with each other.

As the bias control signal GB[n] is changed back to high level, the pre-bias section and the anode reset section are terminated. Next, when the D section (2 1Hs in the embodiment of FIG. 3) is passed, a gate and drain initialization (Gate & Initial) section starts to initialize the gate electrode and the drain electrode of the driving transistor T1. The gate and drain initialization section (Gate & Drain Initial) is also positioned after each odd-numbered 1H is passed from the termination (time at which the bias control signal GB [n] is changed to the high level) of the light emitting section, and this is marked as section A in FIG. 3. In the embodiment of FIG. 3, the section A includes the section B, the section C, and the section D, and is formed of a total of nine 1Hs.

The gate and drain initialization section (Gate & Drain Initial) includes a section during which the gate electrode of the driving transistor T1 is initialized and the section during which the drain electrode (or a second electrode) of the driving transistor T1 is initialized, and signals for controlling the two sections are different from each other.

As the initialization control signal GI[n] is changed to high level, the fourth transistor T4 having received the high-level initialization control signal GI[n] is turned on, and thus the first initialization voltage Vint1 is transmitted to the gate electrode of the driving transistor T1 such that the voltage of the gate electrode of the driving transistor T1 is initialized to the first initialization voltage Vint1. The first initialization voltage Vint1 is also transmitted to one electrode of the sustain electrode Cst connected to the gate electrode of the driving transistor T1, and the storage capacitor Cst stores the received first initialization voltage Vint1 and is initialized. The initialization control signal GI[n] has high level during the section E, and the section E includes four of 1H in the embodiment of FIG. 3.

In a drain initial section (Drain Initial), the drain electrode of the driving transistor T1 is initialized.

As the second scan signal GC[n] is changed to high level, the third transistor T3 having received the high-level second scan signal GC[n] is turned on, and thus the gate electrode and the drain electrode of the driving transistor T1 are connected such that the driving transistor T1 is diode-connected. In this case, the first initialization voltage Vint1 passed through the fourth transistor T4 and then transmitted to the gate electrode of the driving transistor T1 is also transmitted to the drain electrode of the driving transistor T1 such that the drain electrode of the driving transistor T1 is initialized with the first initialization voltage Vint1.

The section (Drain Initial) during which the drain electrode of the driving transistor T1 is initialized corresponds to only a section during which the initialization control signal GI[n] has the high level in the section during which the second scan signal GC[n] has the high level. Referring to FIG. 3, the gate and drain initialization (Gate & Drain Initial) section is the section E, which is a section during which the initialization control signal GI[n] and the second scan signal GC[n] have the high level.

The second scan signal GC[n] has the high level for a section F, which includes the section E (e.g., gate and drain initialization (Gate & Drain Initial) section). The section F starts with the same timing as the section E, but is continued for a constant period of time even after termination of the section E. In FIG. 3, the section F includes twenty 1H. In the section F, sections after termination of the section E (i.e., the gate and drain initialization section, Gate & Drain Initial) are sections during which at least one first scan signal GW[n] is applied, and this section will be called a writing available section hereinafter. Therefore, a section (i.e., the section F) during which the second scan signal GC[n] has a high level includes a gate and drain initialization section (Gate & Drain Initial) (section E) and a writing available section.

The initialization control signal GI[n] has the low level, and at least one first scan signal GW [n] is applied in a section (i.e., the writing available section) during which the second scan signal GC[n] has the high level. The writing available section includes at least one threshold voltage compensation and data writing section (Vth & DW) during which the first scan signal GW[n] has the low level.

In the embodiment of FIG. 3, the section E is terminated as the initialization control signal GI[n] is changed to the low level, and then, after 4 1Hs, the threshold voltage compensation and data writing section (Vth & DW) starts as the first scan signal GE[n] is changed to the low level.

When the first scan signal GW [n] is changed to the low level, the data voltage Data is transmitted to the pixel PX through the second transistor T2, and the transmitted data voltage Data is passed through the driving transistor T1 and the third transistor T3 and then stored in one electrode (i.e., the gate electrode of the driving transistor T1) of the storage capacitor Cst. The data voltage Data stored in the capacitor Cst may be a data voltage Data that is compensated from a threshold voltage of the driving transistor T1.

More specifically, operation for compensating the threshold voltage and writing data will now be described.

The source electrode of the driving transistor T1 has a bias voltage VEH through the pre-bias section (Pre-bias), and the gate electrode and the drain electrode have the first initialization voltage Vint1 through the gate and drain initialization section (Gate & Drain Initial). The bias voltage VEH has a high voltage value, and the first initialization voltage Vint1 has a low voltage value and thus the driving transistor T1 is in the turned-on state due to a voltage difference between the bias voltage VEH and the first initialization voltage Vint1.

In such a state, when the second transistor T2 is turned on by the first scan signal GW[n], the data voltage Data is transmitted to the source electrode of the driving transistor T1. Since the driving transistor T1 is in the turned-on state, the data voltage Data transmitted to the source electrode of the driving transistor T1 is output to the drain electrode of the driving transistor T1 and then transmitted to one electrode (gate electrode of the driving transistor T1) of the storage capacitor Cst through the turned-on third transistor T3. As a result, a voltage of the gate electrode of the driving transistor T1 is gradually increased. Then, the voltage of the gate electrode of the driving transistor T1 is increased to a voltage (a voltage obtained by subtracting the threshold voltage of the driving transistor T1 from the data voltage Data) that turns off the driving transistor T1 such that the driving transistor T1 is turned off. Thus, the voltage stored in one electrode of the storage capacitor Cst has a value obtained by subtracting the threshold voltage of the driving transistor T1 from the data voltage Data. Then, not only is the data voltage Data written into the storage capacitor Cst, but also the threshold voltage of the driving transistor T1 is written into the storage capacitor Cst while being compensated.

When the driving voltage ELVDD is applied to the source electrode of the driving transistor T1 in the light emitting section, the threshold voltage stored in the storage capacitor Cst is used to turn on the driving transistor T1, and the data voltage Data is used to determine the degree of output of the output current of the driving transistor T1. Thus, the intensity of the output current of the driving transistor T1 is changed according to the magnitude of the data voltage Data. The output current of the driving transistor T1 is transmitted to the light emitting diode LED, and luminance of light emitted from the light emitting diode LED is determined according to the intensity of the output current transmitted to the light emitting diode LED.

Referring to FIG. 1, common connection wires (i.e., the light emission control line EM, the bias control line GB, the second scan line GC, and the initialization control line GI) connected to two rows through a single wire are formed, and only the first scan line GW is formed for each row. Thus, the first scan signal GW[n] of the low level is applied to the n-th row, and then a first scan signal GW[n+1] of the low level is applied to the (n+1)-th row in the next 1H. Operation of the (n+1)-th pixel according to the first scan signal GW[n+1] is the same as the case of applying the first scan signal GW[n] to the n-th row.

Referring to FIG. 3, the writing available section includes at least one unit application section G (refer to FIG. 3), which is a single unit section during which the first scan signal GW[n] and the first scan signal GW[n+1] can be applied. The unit application section (section G) includes a first application section shown as hatched and a second application section which is not hatched.

The first application section is a section during which, even when the first scan signal GW[n] and the first scan signal GW[n+1] are applied, a voltage of another signal (e.g., the initialization control signal GI[n]) is not or is little changed, and the second application section is a section during which, when the first scan signal GW [n] and the first scan signal GW[n+1] are applied, a voltage of the other signal (e.g., the initialization control signal GI[n]) is greatly changed compared to the first application section such that unnecessary voltage fluctuation may occur. Thus, in the following embodiment, the first scan signal GW[n] and the first scan signal GW[n+1] may be applied only in the first application section and not applied in the second application section. In embodiments, when a small voltage fluctuation occurs even though the first scan signal GW[n] and the first scan signal GW[n+1] are applied in the second application section, no error occurs in display operation, or no display luminance difference is visible, or required specifications are satisfied, the first scan signal GW[n] and the first scan signal GW[n+1] may be applied in the second application section.

In FIG. 3, the initialization control signal GI[n] has the low level in the writing available section, but there is a difference that the initialization control signal GI[n] is floated and thus has the low level in part of the writing available section, while having the low level by receiving a low level voltage in other sections. Thus, when first scan signal GW[n] and the first scan signal GW[n+1] are applied while the initialization control signal GI[n] is floated, the voltage level of the initialization control signal GI[n] may be easily affected. The section during which the initialization control signal GI[n] is floated corresponds to the second application section, and the section during which the initialization control signal GI[n] receives a voltage of the low level corresponds to the first application section. Therefore, the first scan signal GW [n] and the first scan signal GW [n+1] are applied in the first application section during which the voltage of the low level is applied to the initialization control signal GI[n] and thus the initialization control signal GI[n] has the low level, to thereby reduce fluctuation of the initialization control signal GI[n].

In the embodiment of FIG. 3, four unit application sections (section G) are included. In addition, it is illustrated in FIG. 3 that the first scan signal GW[n] is applied to the first 1H in a first application section of the second unit application section among the four unit application sections, and the first scan signal GW [n+1] is applied to the second 1H. However, it is possible for the first scan signal GW[n] and the first scan signal GW[n+1] to be applied to a first application section of the first unit application section or a first application section of another unit application section.

The writing available section is terminated as the second scan signal GC[n] is changed to the low level from the high level. That is, as the third transistor T3 is turned off and thus the driving transistor T1 no longer has a diode-coupling structure, the data voltage Data cannot be transmitted to the gate electrode of the driving transistor T1 even though the data voltage Data is applied such that the writing operation cannot be carried out.

After the writing available section is terminated and the section B' is passed, a light emitting section starts as the light emission control signal EM[n] is changed to the low level. The section B' includes odd-numbered 1Hs, and in FIG. 3, the section B' includes three 1Hs, which have the same length as the section B.

During the light emitting section, the light emission control signal EM[n] of the low level is transmitted to the gate electrode of the fifth transistor T5 and the gate electrode of the sixth transistor T6 and thus the fifth transistor T5 and the sixth transistor T6 are turned on, and the driving transistor T1 outputs an output current according to the written data voltage Data and transmits the output current to the anode of the light emitting diode LED.

The fifth transistor T5 transmits the driving voltage EVDD of high level to the source electrode of the driving transistor T1 such that the driving transistor T1 outputs the output current by voltages of the source and gate electrodes. The voltage of the gate electrode of the driving transistor T1 equals a voltage stored in one electrode of the storage capacitor Cst, and the voltage stored in one electrode of the storage capacitor Cst has a value obtained by compensating the data voltage Data applied to the pixel PX with the threshold voltage value of the driving transistor T1 through the threshold voltage compensation and data writing section (Vth & DW). The threshold voltage value of the driving transistor T1 is used to turn on the driving transistor T1 together with the driving voltage ELVDD, and the data voltage Data is used to determine the intensity of the current output by the turned-on driving transistor T1. Thus, although the driving transistor T1 provided in each pixel has a different threshold voltage value, the driving transistor T1 outputs an output current based on the written data voltage Data regardless of the threshold voltage value.

The sixth transistor T6 is also turned on such that the drain electrode of the driving transistor T1 and the anode of the light emitting diode LED are connected. Thus, the current output from the driving transistor T1 is transmitted to the anode of the light emitting diode LED and thus the light emitting diode LED emits light. The light emitting diode LED emits light with luminance that changes according to the intensity of the output current of the driving transistor T1.

After that, as the light emission control signal EM[n] is changed back to the high level, the light emitting section is terminated and one frame ends. The next frame starts from the section B.

A section (i.e., non-light emission section) during which the light emission control signal EM[n] has the high level is relatively shorter than the light emission section during which the light emission control signal EM[n] has the low level. During this long light emitting section, the voltages of the anode and cathode are maintained by a capacitor Cled for the light emitting diode so that the light emitting diode LED can emit light of constant luminance. In this case, the storage capacitor Cst also maintains a constant voltage of the gate electrode of the driving transistor T1.

In FIG. 3, the first application section and the second application section in the unit application section (section G) are respectively formed of 2 1Hs. A length of the first application section and a length of the second application section may correspond to the number of pixels PX to which the light emission control line EM, the bias control line GB, the second scan line GC, or the initialization control line GI are connected together. That is, since the light emission control line EM, the bias control line GB, the second scan line GC, and the initialization control line GI are connected to pixels PX of two rows together in in FIG. 1, in FIG. 3, the first application section and the second application section each has a width of 2 1Hs, and the unit application section (section G) of the first scan signal GW[n] has two times the width of 2 1Hs, that is, a width of 4 1Hs.

The width of the unit application section unit may be equivalent to the width of the pre-bias and anode reset section (i.e., the section C) or the width of the gate and drain initialization section (Gate & Drain Initial) (i.e., the section E).

In such a waveform diagram of FIG. 3, the following features are included.

First, after termination of the light emitting section, odd-numbered 1Hs are positioned until "Pre-bias & anode reset" and "Gate & Drain Initial".

That is, after the light emission control signal EM[n] is changed to the high level and the odd-numbered 1Hs section (i.e., the section B in FIG. 3) are passed, the pre-bias and anode reset section starts as the bias control signal GB[n] is changed to the low level.

After the light emission control signal EM[n] is changed to the high level and odd-numbered 1Hs (i.e., the section A in FIG. 3) are passed, the gate and drain initialization section (Gate & Drain Initial) starts as the second scan signal GC[n] and the initialization control signal GI[n] are changed to the high level.

The drain initialization section (Drain Initial) starts after odd-numbered 1Hs are passed from the termination of the light emitting section, and thus it starts as the third transistor T3 is turned on after the section during which the light emitting diode emits light and odd-numbered 1Hs are passed.

The gate initialization section (Gate Initial) starts after the light emitting section is terminated and odd-numbered 1Hs are passed, and thus it starts as the fourth transistor T4 is turned on after the section during which the light emitting diode emits light and odd-numbered 1Hs are passed.

As described, when the termination time of the light emission section and the start time of each section are different by as much as add-numbered 1Hs, the light emission control signal EM[n] applied to the subsequent pixel row is applied every 2 1Hs, and thus the light emission control signal EM[n] and the application timing do not overlap. Accordingly, high level voltages can be generated and output at different timings, and thus drawbacks such as a decrease of the high level voltage value generated when performing with the same timing or causing a relatively significant change by influencing the peripheral signal with the same timing, and the like, may be eliminated.

In FIG. 3, the section B is formed of three 1Hs and the section A is formed of nine 1Hs, but this is not restrictive, and the section B and the section A each may include various odd-numbered 1Hs, such as 1, 3, 5, 7, 9, and the like. In the waveform diagram of FIG. 3, the section B', which is a period until the light emission section starts from termination of the writing available section, is formed of odd-numbered 1Hs.

Next, the section for initializing the gate electrode of the driving transistor T1 and the section for initializing the drain electrode of the driving transistor T1 overlap.

Referring to FIG. 3, the section (Gate Initial) during which the gate electrode of the driving transistor T1 is initialized by using the initialization control signal GI[n] and the section (Drain Initial) during which the drain electrode of the driving transistor T1 is initialized by using the second scan signal GC[n] are illustrated as the section E, and the two sections overlap for more than 1H. More specifically, the section (Gate Initial) during which the initialization control signal GI[n] is applied as the high level and the gate electrode of the driving transistor T1 is initialized is included in the section (Drain Initial) during which the second scan signal GC[n] is applied as the high level and the drain electrode of the driving transistor T1 is initialized, and the two sections start with the same timing.

Depending on embodiments, the section for initializing the gate electrode of the driving transistor T1 and the section for initializing the drain electrode of the driving transistor T1 may at least partially overlap each other. That is, the section during which the third transistor T3 is turned on and thus connects the drain electrode and the gate electrode of the driving transistor T1 and the section during which the fourth transistor T4 is turned on and thus changes the voltage of the gate electrode of the driving transistor T1 to the first initialization voltage Vint1 may at least partially overlap.

The section during which the gate electrode of the driving transistor T1 is initialized is shorter than the section during which the drain electrode of the gate electrode is initialized, and thus all or at least a part of the section during which the gate electrode of the driving transistor T1 is initialized may be included in the section during which the drain electrode of the driving transistor T1 is initialized.

The section for initializing the drain electrode of the driving transistor T1 may start before the initialization of the gate electrode of the driving transistor T1 is terminated. That is, the level of the second scan signal GC[n] is set to change to the high level while the gate electrode of the driving transistor T1 is being initialized, and thus, even though the voltage level of the second scan signal GC[n] is changed due to coupling between the gate electrode of the driving transistor T1 and the first scan line GW to which the second scan signal GC[n] is applied, the voltage of the gate electrode of the driving transistor T1 is eventually initialized with the first initialization voltage Vint1. Thus, there is no change in the gate electrode initialization voltage (i.e., the first initialization voltage) of the driving transistor T1.

Next, a writing available section during which the first scan signal GW[n] and the first scan signal GW[n+1] can be applied may have a plurality of unit application sections (section G), and a single unit application section (section G) includes a first application section and a second application section. The first application section may be a section in which it is appropriate to apply the first scan signal GW[n] and the first scan signal GW[n+1] because a voltage change at the periphery hardly occurs even though the first scan signal GW[n] and the first scan signal GW[n+1] are applied. On the contrary, the second application section is a section during which a voltage change occurs relatively significantly when the first scan signal GW [n] and the first scan signal GW[n+1] are applied and it needs to check whether or not an unnecessary side effect occurs, and thus application of the scan signal GW[n] and first scan signal GW[n+1] may not be appropriate depending on embodiments. In the embodiment of FIG. 3, the section that can apply the first scan signal GW[n] and the first scan signal GW[n+1] may be a (1+4n)-th H or a (2+4n)-th H in the writing available section.

The initialization control signal GI[n] is directly applied as a low level voltage in the first application section, and thus the voltage level of the initialization control signal GI[n] is maintained at the low level voltage without a voltage level change due to coupling even though the first scan signal GW[n] and the first scan signal GW[n+1] are applied in the first application section.

However, the initialization control signal GI[n] is floated in the second application section, and thus when the first scan signal GW[n] and the first scan signal GW[n+1] are applied in the second application section, a voltage change of a wire (i.e., the initialization control line GI) that receives the initialization control signal GI[n] may significantly occur due to coupling. A voltage of an electrode (i.e., the gate electrode of the fourth transistor T4) connected to the initialization control line GI may be unstable.

In embodiments, the first scan signal GW[n] and the first scan signal GW[n+1] are applied only during the first application section among the unit application sections (section G).

A state in which a fourth transistor T4 is in a turned-off state and a third transistor T3 is in a turned-on state is called a writing available section. After the section (Gate Initial) during which the gate electrode of the driving transistor T1 is initialized is terminated, the section (Gate Initial) during which the drain electrode of the driving transistor T1 is initialized may also be called the writing available section. The writing available section may be a section in which the drain electrode and the gate electrode of the driving transistor T1 are connected with each other through the third transistor T3.

The writing available section includes a plurality of unit application sections, and the plurality of unit application sections include a first application section during which that the second transistor T2 can be turned on and a second application section during which the second transistor T2 is not turned on. A threshold voltage compensation and data writing section (Vth & DW) is provided in one 1H among the writing available section such that that second transistor T2 can be turned on. The second application section may be a section during which an initialization control signal that controls the fourth transistor T4 is floated. In addition to the above features, various features may be further included, and depending on embodiments, only some of the above three features may be included.

Hereinafter, each feature will be described in more detail through drawings.

Regarding the first feature (a gap of odd-numbered 1Hs), a difference will be described by using a comparative example in FIG. 4 and FIG. 5.

Figure 4:
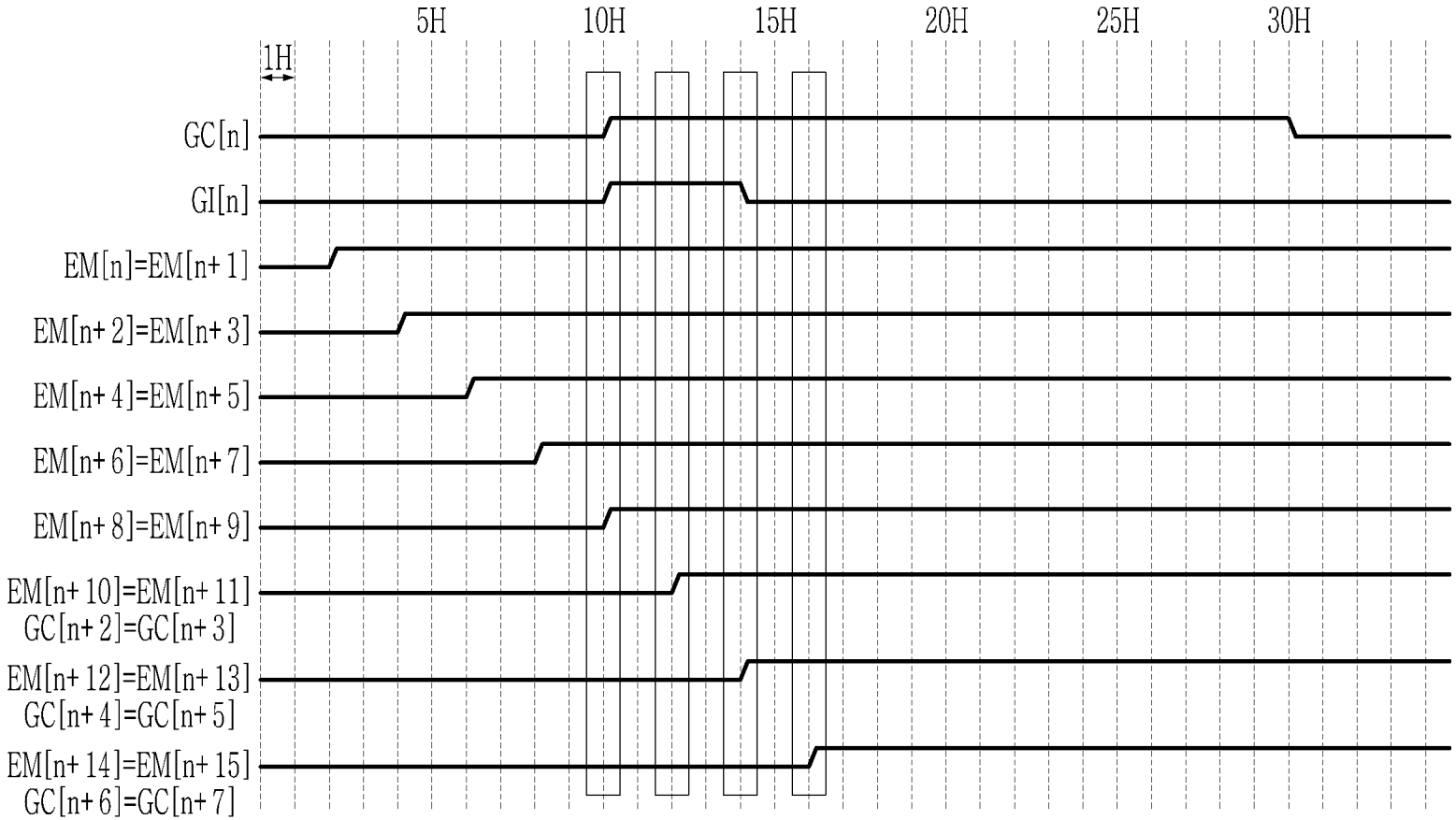
FIG. 4 is a waveform diagram that illustrates signals applied in a comparative example.
Figure 5:
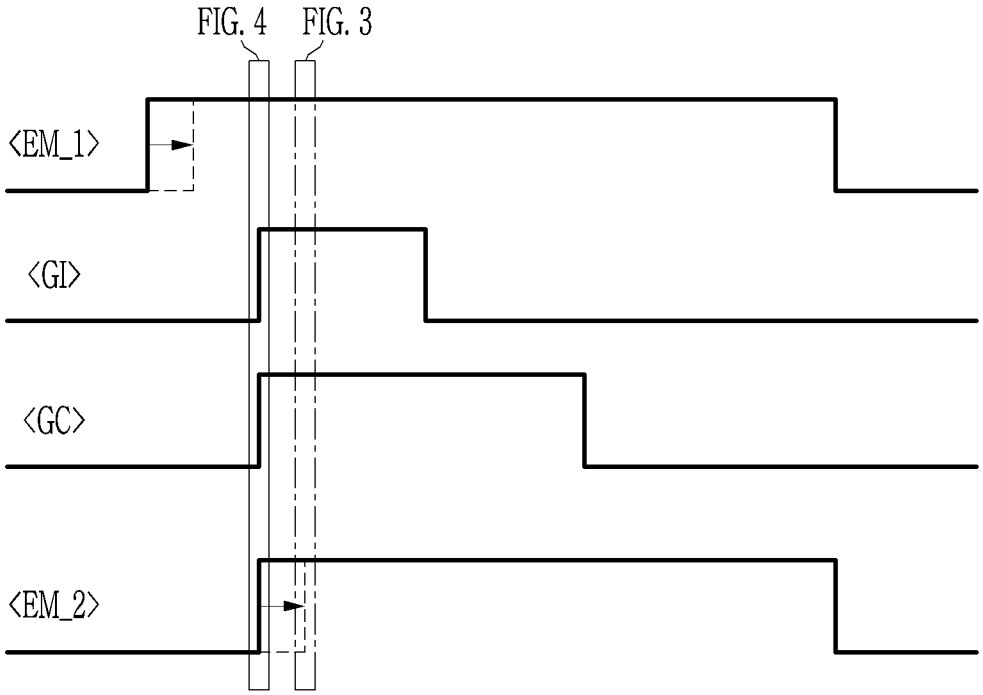
FIG. 5 is a waveform diagram that compares signals in a comparative example and signals in an embodiment.

FIG. 4 is a waveform diagram that illustrates signals applied in a comparative example, and FIG. 5 is a waveform diagram that compares signals in the comparative example and the embodiment.

FIG. 4 illustrates a comparative example in which a light emission control signal EM[n] and a second scan signal GC[n] or an initialization control signal GI[n] differ by even-numbered 1Hs, and light emission control signals EM[n] applied to different pixel rows in this case are also shown. In the comparative example of FIG. 4, the light emission control signal EM[n] applied to the pixel in the present row has timing that changes to a high level by 8 1Hs ahead of the second scan signal GC[n] or initialization control signal GI[n].

As described, when there is a difference of the even-numbered 1H, as shown in the box of FIG. 4, the timing at which the second scan signal GC[n] or the initialization control signal GI[n] is converted to high level and the timing at which the light emission control signal EM[n] is converted to high level overlap. In such a case, when a driver generates and outputs the high level of the light emission control signal EM[n] and the high level of the second scan signal GC[n] or initialization control signal GI[n] simultaneously, there is a disadvantage that a high level voltage value decreases by a certain level.

Referring to FIG. 4, a light emission control signal EM[n+10] and the light emission control signal EM[n+11] are the same, and they are changed to high levels with the same timing also as a second signal GC[n+2] and a second scan signal GC[n+3]. In addition, it is illustrated in FIG. 4 that the light emission control signal EM[n+12] and the light emission control signal EM[n+13] are the same, and they are changed to the high level with the same timing also as a second scan signal GC[n+4] and a second scan signal GC[n+5], and a light emission control signal EM[n+14] and a light emission control signal EM[n+15] are the same, and they are changed to the high level with the same timing also as a second scan signal GC[n+6] and a second scan signal GC[n+7]. Since such a relationship occurs as a whole of the light emitting display device, the problem that the voltage value of the high level decreases affects the entire light emitting display device, which can cause display quality problems and be recognized as crosstalk.

Referring to FIG. 5, the solid line corresponds to the comparative example of FIG. 4, and the dotted line portion, which is the light emission control signals <EM_1> and <EM_2> delayed by 1H back, corresponds to the embodiment of FIG. 3.

Referring to FIG. 5, in the embodiment of FIG. 4, the light emission control signal <EM_2> is changed to the high level with the same timing as GC and GI, which are the second scan signal and the initialization control signal, but in the embodiment of FIG. 4, timing of each of the light emission control signals <EM_1> and <EM_2> is pushed by 1H, thereby causing occurrence of a difference of odd-numbered Hs, and thus the light emission control signal is changed to the high level at different timing from that of the second scan signal GC and the initialization control signal GI (timing with 1H difference). Accordingly, high level voltages can be generated and output at different timings, and thus drawbacks such as decrease of the high level voltage value generated when performing with the same timing or causing a relatively significant change by influencing the peripheral signal with the same timing, and the like, may be eliminated.

Hereinafter, regarding the second feature (overlapping of the section for initializing the gate electrode of the driving transistor T1 and the section for initializing the drain electrode of the driving transistor T1), a difference will be described with reference to a comparative example of FIG. 6.

Figure 6:
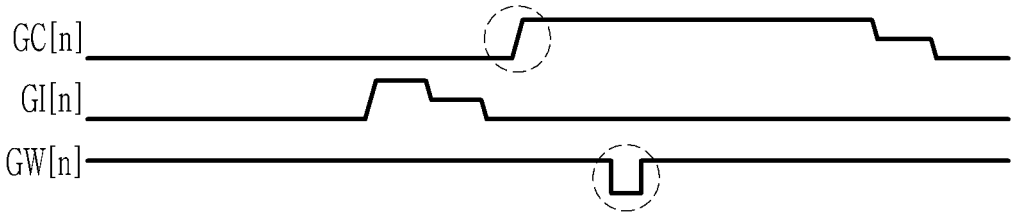
FIG. 6 is a waveform diagram of signals applied in a comparative example.

FIG. 6 is a waveform diagram of signals applied in a comparative example.

In the comparative example of FIG. 6, unlike the embodiment of FIG. 3, timing at which an initialization control signal GI[n] that initializes a gate electrode of a driving transistor T1 and timing at which a second scan signal GC[n] that initializes a drain electrode of the driving transistor T1 do not overlap, and a gate initialization section and a drain initialization section do not overlap. That is, timing at which, after the initialization control signal GI[n] is changed to the high level and then to the low level, the second scan signal GC[n] is applied while being changed to the high level is illustrated.

Operation of the pixel of FIG. 2 will now be described according to such a comparative example of FIG. 6.

First, the fourth transistor T4 is turned on as the initialization control signal GI[n] is changed to the high level, and thus the first initialization voltage Vint1 is transmitted to the gate electrode of the driving transistor T1 such that the voltage of the gate electrode of the driving transistor T1 is initialized to the first initialization voltage Vint1. In this case, the first initialization voltage Vint1 is stored in one electrode of the storage capacitor Cst. After that, the fourth transistor T4 is turned off as the initialization control signal GI[n] is changed to the low level, and thus the first initialization voltage Vint1 is no longer applied to the gate electrode of the driving transistor T1 and one electrode of the storage capacitor Cst.

After that, the third transistor T3 is turned on as the second scan signal GC[n] is changed to the high level, and the voltage stored in one electrode of the storage capacitor Cst is changed due to coupling. That is, since the first initialization voltage Vint1 is no longer applied to the gate electrode of the driving transistor T1 and one electrode of the storage capacitor Cst, the voltage of one electrode of the storage capacitor Cst is changed due to coupling occurring due to a change in the peripheral voltage level. Since the second scan signal GC[n] is changed to the high level, the voltage of the gate electrode of the driving transistor T1 and the voltage of one electrode of the storage capacitor Cst are also increased due to coupling. The increase of the voltage of the gate electrode may cause a problem in displaying peak luminance because the driving transistor T1 may not be turned on in the threshold voltage compensation and data writing section or the duration of the turned-on period of the driving transistor T1 may not be sufficiently assured even though the driving transistor T1 is turned on.

Therefore, unlike the comparative example of FIG. 6, in the embodiment, the section in which the drain electrode of the driving transistor T1 is initialized may be set to be started before initialization of the gate electrode of the driving transistor T1 is terminated. That is, the level of the second scan signal GC[n] is set to be changed to the high level while the gate electrode of the driving transistor T1 is being initialized, and thus, even though a change occurs in the second scan signal GC[n] due to coupling between the gate electrode of the driving transistor T1 and the first scan line GW to which the second scan signal GC[n] is applied, the voltage of the gate electrode of the driving transistor T1 is eventually initialized to the first initialization voltage Vint1. Thus, there is no change in the gate electrode initialization voltage (first initialization voltage Vint1) of the driving transistor T1, and thus, in the subsequent threshold voltage compensation and data writing section, the turn-on characteristic of the driving transistor T1 is not changed.

Hereinafter, regarding the third feature (the first scan signal GW[n] is applied in the first application section of the unit application sections), a difference will be described by using waveforms of a comparative example and an embodiment of FIG. 7 and FIG. 8 will be described.

Figure 7:
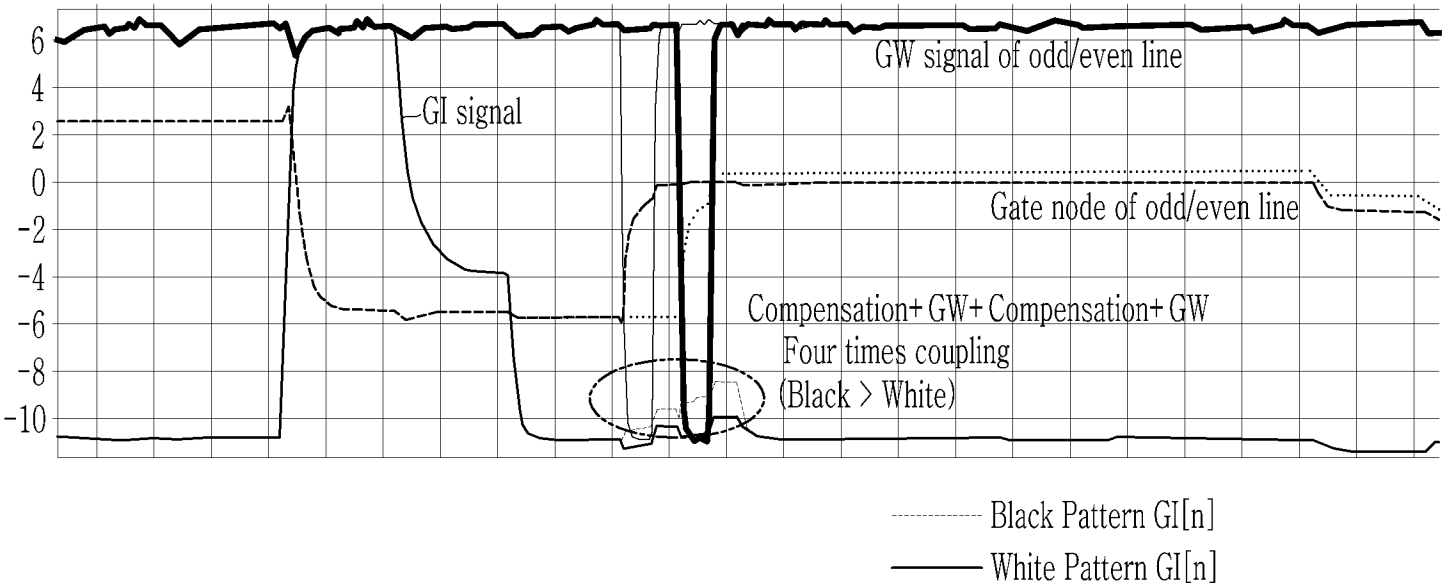
FIG. 7 is a waveform diagram of waveforms of signals measured in a comparative example.
Figure 8:
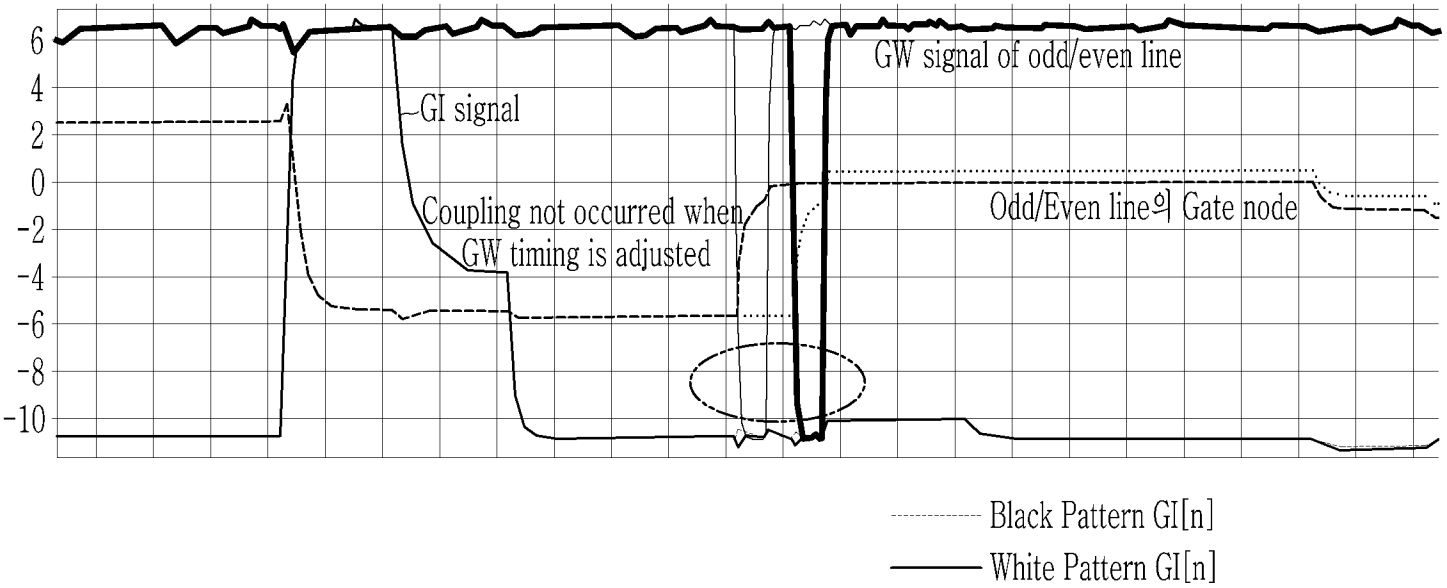
FIG. 8 is a waveform diagram of waveforms of signals measured in an embodiment.

FIG. 7 is a waveform diagram of waveforms of signals measured in a comparative example, and FIG. 8 is a waveform diagram of waveforms of signals measured in an embodiment.

In the comparative example of FIG. 7, a first scan signal GW[n] is applied in a second application section among unit application sections, and in the embodiment of FIG. 8, the first scan signal GW[n] is applied in a first application section among the unit application sections as in FIG. 3.

In the comparative example of FIG. 7, the second application section during which the first scan signal GW [n] is applied is a section during which an initialization control signal GI[n] is floated, and, in the embodiment of FIG. 8, the first application section during which the first scan signal GW[n] is applied is a section during which a low level voltage is directly applied to the initialization control signal GI[n].

In the waveform diagrams of FIG. 7 and FIG. 8, voltage waveforms of the first scan signal GW[n], the initialization control signal GI[n], and the gate electrode (illustrated as Gate nodes in FIG. 7 and FIG. 8) of the driving transistor T1 are illustrated. In particular, in FIG. 7 and FIG. 8, waveforms of pixels in two rows (odd/even lines) are included, and a voltage waveform pattern of a case that each pixel displays black and a voltage waveform pattern of a case that each pixel displays white are illustrated.

Comparing a data voltage Data of the case of displaying white and a data voltage Data of a case of displaying black, the data voltage Data of the case of displaying white has a lower voltage, and thus an output current of the driving transistor T1 is increased, to thereby increase display luminance of the light emitting diode LED. The data voltage Data of the case of displaying black is sufficiently high and thus the driving transistor T1 is not turned on, and in this case, the driving transistor T1 does not generate an output current such that the light emitting diode LED does not generate luminance.

As in the comparative example of FIG. 7, when the first scan signal GW[n] is changed to the low level while the initialization control signal GI[n] is being floated, the data voltage Data is input to the pixel and thus being coupled with the initialization control signal GI[n] such that the voltage of the initialization control signal GI[n] is changed. In addition, when the first scan signal GW[n] is changed back to the high level, the first scan signal GW[n] is accordingly coupled with the initialization control signal GI[n], and thus the voltage of the initialization control signal GI[n] is increased. In particular, a voltage change of the initialization control signal GI[n] of the data voltage Data of the case of displaying black, which requires a relatively high voltage value, is significant. Such a voltage change of the initialization control signal GI[n] is marked by the circle in FIG. 7.

Referring to the circled portion of FIG. 7, the voltage of the initialization control signal GI[n] is changed a total of four times. That is, the initialization control signal GI[n] is changed when a first scan signal GW[n] of the previous stage is changed to the low level and then is changed when the first scan signal GW[n] of the previous stage is changed to the high level, and then the initialization control signal GI[n] is changed when a first scan signal GE[n+1] of the next row is changed to the low level and then when the first scan signal GE[n+1] is changed back to the high level, and thus a total of four voltage changes occur. Due to the voltage change of adjacent rows, differences in display luminance may occur due to crosstalk across the panel, and differences in luminance in pixels of two rows (odd/even lines) may be viewed.

On the contrary, in the embodiment of FIG. 8, the first scan signal GW [n] is changed to the low level while a low level voltage is directly applied to the initialization control signal GI[n], and thus, even though the data voltage Data is coupled with the initialization control signal GI[n] while being input to the pixel, no voltage change occurs in the initialization control signal GI[n] as shown in the circled portion of FIG. 8. Accordingly, a luminance difference in pixels of two rows (odd/even lines) is not viewed.

As shown in FIG. 7, due to a crosstalk which occurs when the voltage of the floated initialization control signal GI[n] is changed as shown in FIG. 7, it is not possible to set the first scan signal GW [n] to be applied in the second application section among the unit application sections. However, when a display luminance difference is not viewed even when the voltage change of the initialization control signal GI[n] occurs as in FIG. 7, or the display luminance difference is included within an allowable range, the first scan signal GW [n] may be exceptionally applied in the second application section.

Hereinafter, an embodiment of FIG. 9, in which a voltage level of each signal is changed one more time rather than being maintained constantly, not as in FIG. 3, will be described.

Figure 9:
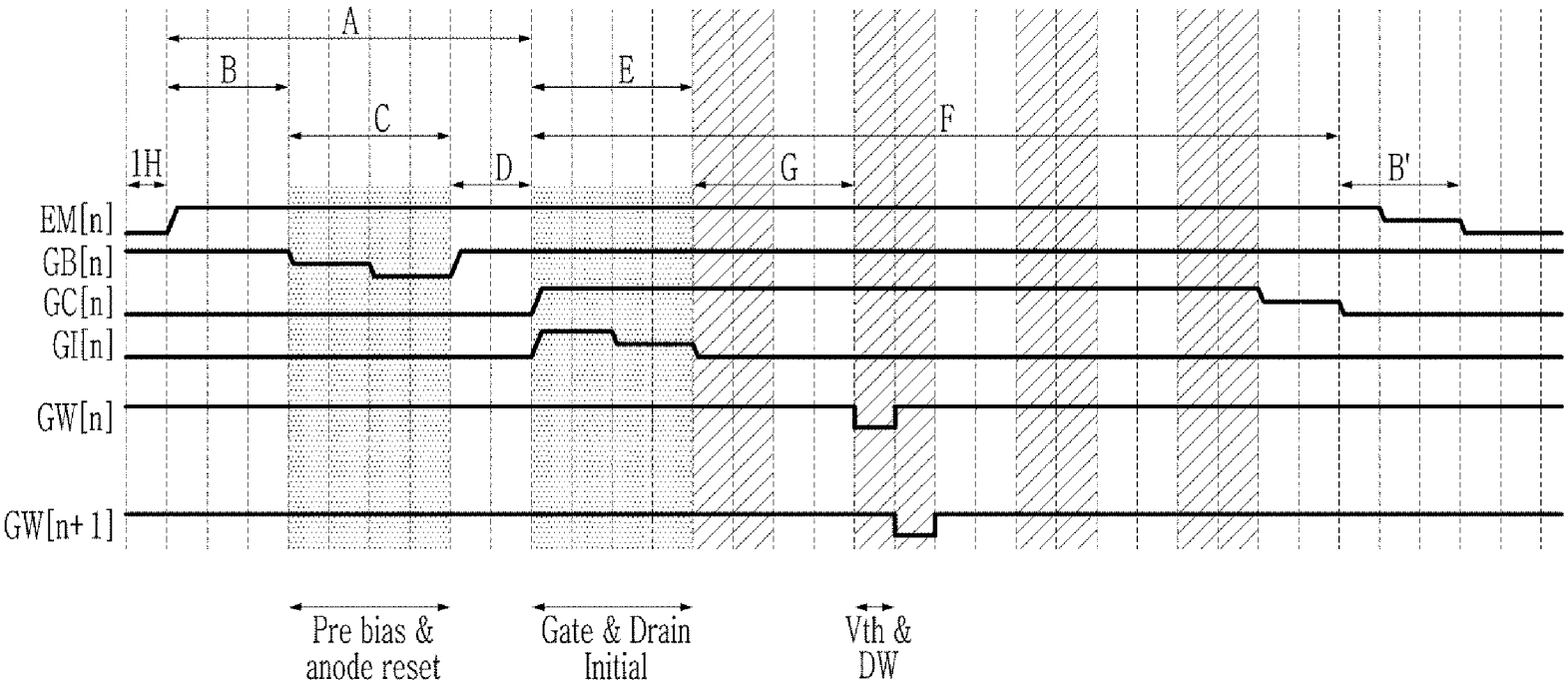
FIG. 9 is a waveform diagram of signals applied to the pixel of FIG. 2 according to an embodiment.

FIG. 9 is a waveform diagram of signals applied to the pixel of FIG. 2 according to an embodiment.

Unlike the embodiment of FIG. 3, in the embodiment of FIG. 9, a high or low level voltage applied to each section is slightly dropped before being changed.

Such a voltage level change may not include deliberately dropping the voltage, and may be a voltage change that collaterally occurs when a voltage is directly applied to a specific section in generation of each signal, while being floated in other portions, or due to a change in a voltage applied to the periphery.

The voltage change is a fluctuation of the voltage level to a level where there is no problem in performing the operation of each section of the pixel.

Three features are included in the embodiment of FIG. 9 as in FIG. 3, and this will be described in more detail with reference to FIG. 10 to FIG. 12.

Figure 10:
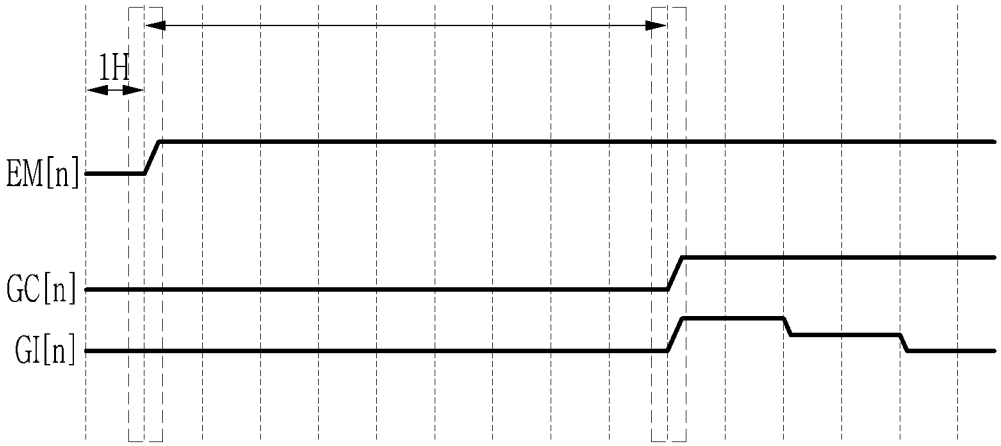
FIG. 10, FIG. 11, and FIG. 12 are waveform diagrams according to one or more embodiments.
Figure 11:
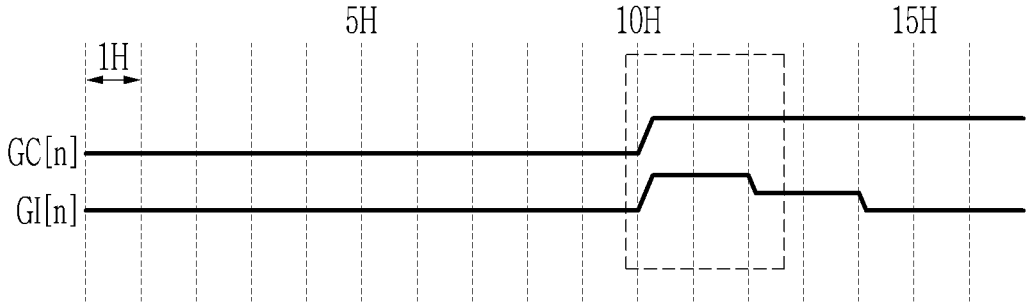
Figure 12:
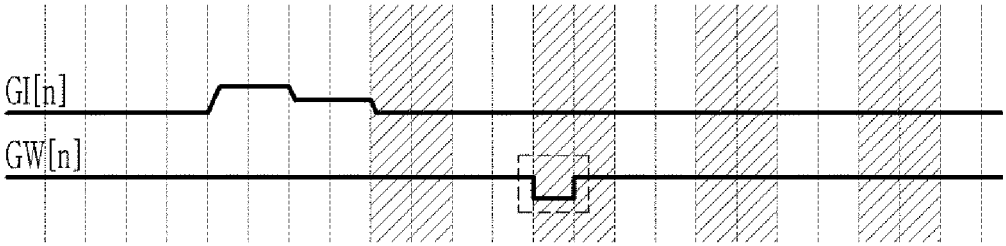

FIG. 10, FIG. 11, and FIG. 12 are waveform diagrams according to one or more embodiments.

First, the first feature will be described with reference to FIG. 10.

The first feature, that is, there are odd-numbered 1Hs positioned between the termination of the light emitting section and the pre-bias and anode reset section and the gate and drain initialization section, and in FIG. 10, the gate and drain initialization section (Gate & Drain Initial) is illustrated.

That is, after the odd-numbered 1Hs are passed from change of the light emission control signal EM[n] to the high level, the gate and drain initialization section starts as the second scan signal GC[n] and the initialization control signal GI[n] are changed to the high level. In FIG. 10, it can be determined that a gap of 9 1Hs is provided.

Although it is not illustrated in FIG. 10, referring to FIG. 9, odd-numbered 1Hs are positioned between the termination of the light emitting section and the pre-bias and anode reset section. That is, after the odd-numbered 1Hs are passed from the change of the light emission control signal EM[n] to the high level, the pre-bias and anode reset section starts as the bias control signal GB[n] is changed to the low level. In FIG. 9, it can be determined that a gap of 3 1Hs is provided.

Such a first feature causes timing with which the, light emission control signal EM[n] is changed and timing with which the second scan signal GC[n], the initialization control signal GI[n], or the bias control signal GB[n] is changed to be different from each other such that drawbacks such as decrease of the high level voltage value generated when performing with the same timing or causing a relatively significant change by influencing the peripheral signal with the same timing, and the like, may be eliminated.

Referring to FIG. 11, the second feature, that is, the section during which the gate electrode of the driving transistor T1 is initialized and the section during which the drain electrode of the driving transistor is initialized are set to be overlapped with each other will be described.

In FIG. 11, the initialization control signal GI[n] and the second scan signal GC[n] are changed to the low level with the same timing and the initialization control signal GI[n] is changed to the low level earlier, and thus the section (Gate Initial) during which the gate electrode of the driving transistor T1 is initialized is included in the section (Drain Initial) during which the drain electrode of the driving transistor T1 is initialized, and thus the two sections are overlapped.

Thus, the second scan signal GC[n] is not changed to the high level while the gate electrode of the driving transistor T1 is being initialized, and thus a change in an initialization voltage (first initialization voltage Vint1) of the gate electrode of the driving transistor T1 due to a voltage level change of the second scan signal GC[n] does not occur.

Referring to FIG. 12, the third feature, that is, the first scan signal GW[n] is set to be applied in the first application section (the section indicated by slashes in FIG. 12) among the unit application sections, will be described.

That is, the initialization control signal GI[n] is applied with the low level voltage in the first application section and thus the low level voltage can be maintained in the first application section even though there is a voltage change due to application of first scan signal GW[n] and the first scan signal GW[n+1] in the first application section, but it is floated in the second application section, and thus a voltage change of a wire (i.e., the initialization control line GI) that receives the initialization control line GI[n] may be significant when the first scan signal GW[n] is applied in the second application section. Thus, the voltage change can be reduced by applying the first scan signal GW[n] in the first application section during which the initialization control signal GI [n] directly receives the low level voltage.

In FIG. 12, it is illustrated that the first scan signal GW[n] is applied in the first 1H of a first section of the second unit application section among four unit application sections. However, it may be also deformable to apply the first scan signal GW [n] to the second 1H of the first section of the second unit application section, or apply the first scan signal GW[n] to other first application section marked by slashes.

Hereinafter, a method for driving with a low frequency according to an embodiment will be described with reference to FIG. 13.

Figure 13:
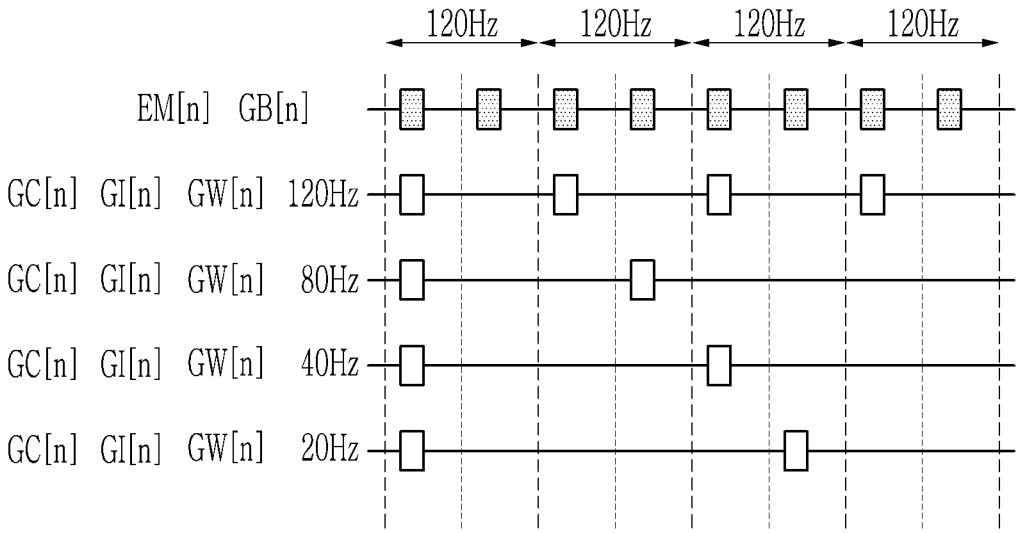
FIG. 13 is a timing diagram of signals applied to a light emitting display device according to an embodiment.

FIG. 13 is a timing diagram of a signal applied to a light emitting display device according to an embodiment.

The low-frequency driving method of FIG. 13 may be applied to FIG. 3 to FIG. 9, and may also be applied to FIG. 15, which will be described later.

The low-frequency driving method will now be described with reference to the pixel of FIG. 2.

The signal to be applied to the pixel PX may be classified into two types, that is, a control signal including a light emission control signal EM[n] and a bias control signal GB[n], and a writing signal including a first scan signal GW[n], a second scan signal GC[n], and an initialization control signal GI[n].

Although it is not illustrated in FIG. 13, in general, the control signals (EM[n] and GB[n]) and the writing signals (GW[n], GC[n], and GI[n]) may be applied in each frame with the same driving frequency. In this case, a threshold voltage compensation and data writing section (Vth & DW) is carried out for each frame, and thus a new data voltage Data is written for each frame. Hereinafter, such a driving method is referred to as normal frequency driving as compared to the low-frequency driving method.

However, in the low-frequency driving, the writing signals (GW[n], GC[n], and GI[n]) are not additionally applied and thus no new data voltage Data is written, but only the control signals (EM[n] and GB[n]) are operated to display the same luminance using the previously stored data voltage Data. Such low-frequency driving has a merit in terms of power consumption because unnecessary power consumption can be eliminated when displaying a still image. That is, although the control signals (EM[n] and GB[n]) are applied for each frame, a frame in which the threshold voltage compensation and data writing section (Vth & DW) is carried out may be carried out once every few frames.

In FIG. 13, the portions marked by quadrangular boxes show positions where the control signals (EM[n] and GB[n]) or the writing signal (GW[n] and GC[n], GI[n]) are applied.

Referring to FIG. 13, when the control signals (EM[n] and GB[n]) are driven at 240 Hz, the writing signals (GW [n], GC[n], and GI[n]) may be driven at various driving frequencies, and as examples, 120 Hz, 80 Hz, 40 Hz, and 20 Hz are illustrated. That is, each frame is displayed as 240 Hz, but a frame where data is actually written may be one of 120 Hz, 80 Hz, 40 Hz, and 20 Hz, and thus it may be applicable in case of a still image, and power consumption can be reduced.

However, not as in FIG. 13, the control signals (EM[n] and GB[n]) may be applied with a driving frequency of 120 Hz or other driving frequencies, and in this case, the writing signals (GW[n], GC[n], and GI[n]) may be applied with a frequency that is lower than the driving frequency of the control signals (EM[n] and GB[n]).

In the low frequency driving, based on the existing data voltage Data stored in the storage capacitor Cst, the bias control signal GB[n] is applied and thus a bias voltage VEH is applied to the source electrode of the driving transistor T1 such that the driving transistor T1 is set to be on bias, and then the light emission control signal EM[n] is applied for light emission.

In this case, a voltage value of the bias voltage VEH may be different from a voltage value of the bias voltage VEH, which has been applied at normal frequency driving, and in the low frequency driving, the voltage value of the bias voltage VEH may be changed depending on time or pre-applied data voltage Data.

When the low frequency driving is carried out as in the embodiment of FIG. 13, writing of the data voltage Data may not need to be performed for each frame, thereby reducing power consumption, and on bias setting is carried out on the driving transistor T1 for each frame while applying a bias voltage VEH that can be changed, thereby preventing deterioration of display luminance. Accordingly, low frequency driving with low power consumption can be carried out without causing deterioration of display quality.

Hereinabove, as shown in FIG. 1, the embodiment in which some of signals are applied together to the pixels PX of two rows by using the common connection wires (i.e., the light emission control line EM, the bias control line GB, the second scan line GC, and the initialization control line GI) has been described. Depending on embodiments, the common connection wires may be formed in pixels PX of three or more rows.

Hereinafter, an embodiment in which a common connection wire is not included will be described with reference to FIG. 14 to FIG. 16.

First, a light emitting display device according to another embodiment will be described with reference to FIG. 14.

Figure 14:
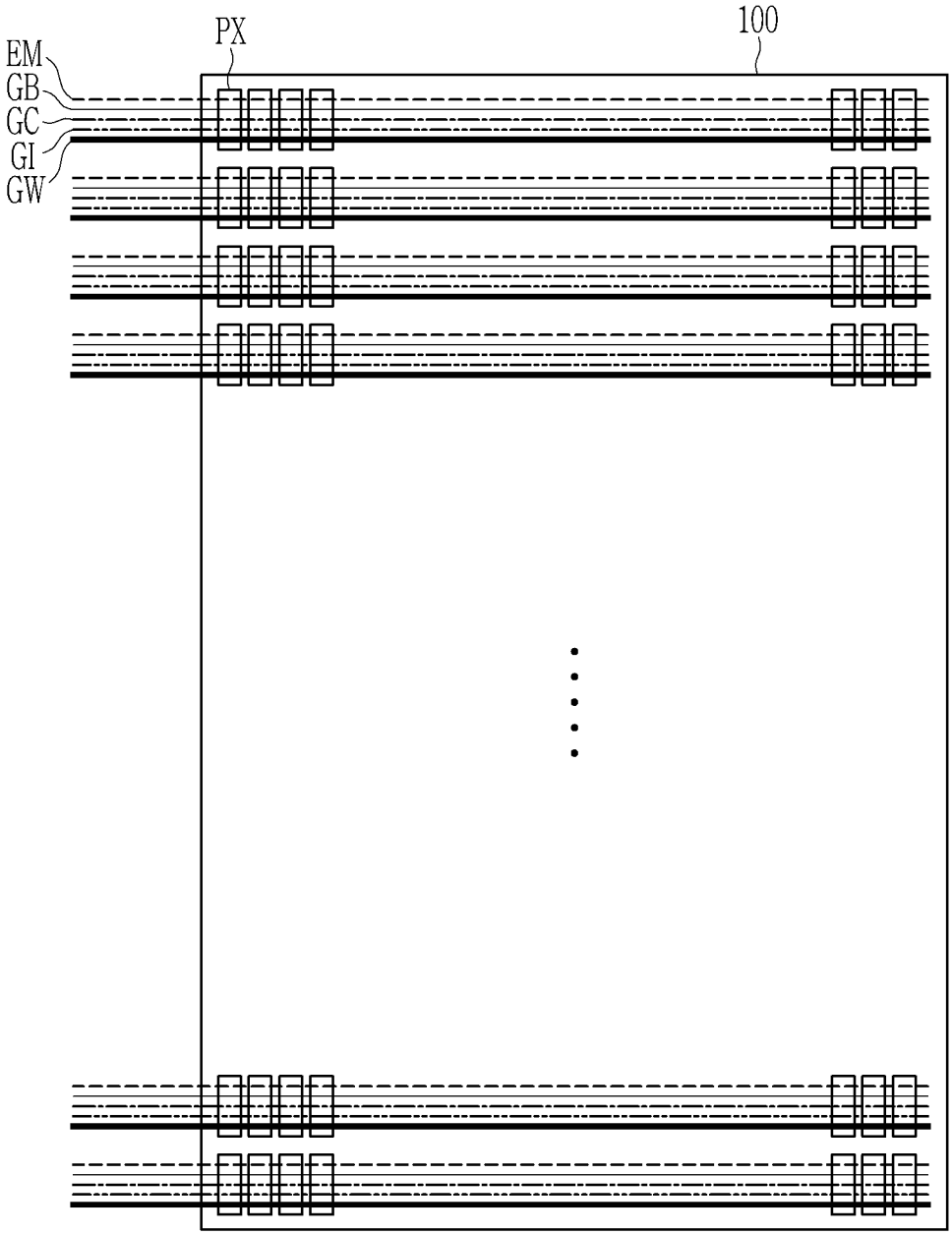
FIG. 14 is a schematic diagram of a light emitting display device according to an embodiment.

FIG. 14 is a schematic diagram of a light emitting display device according to an embodiment.

In FIG. 14, not as in FIG. 1, a light emission control line EM, a bias control line GB, a second scan line GC, an initialization control line GI, and a first scan line GW are formed for every single pixel PX row.

A structure of the pixel PX in FIG. 14 may be the same as that of FIG. 2.

Figure 15:
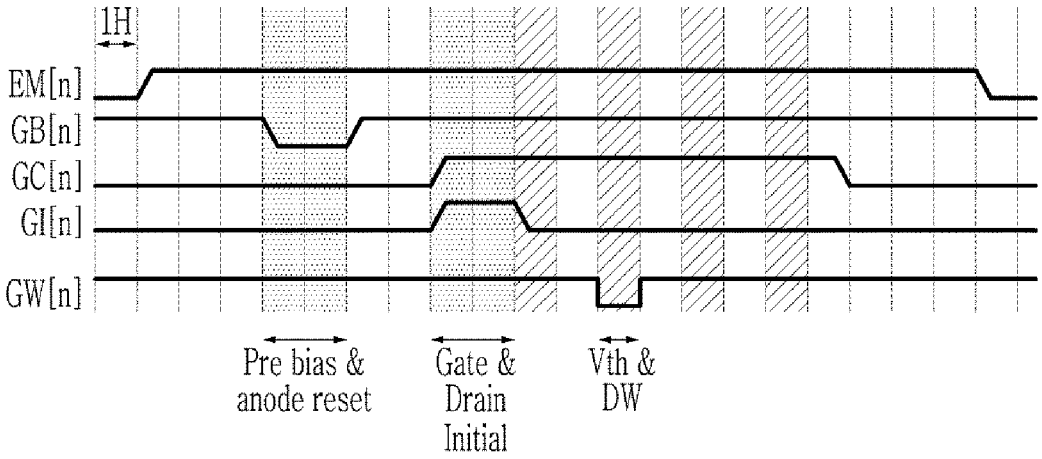
FIG. 15 and FIG. 16 are waveform diagrams of signals according to one or more embodiments.
Figure 16:
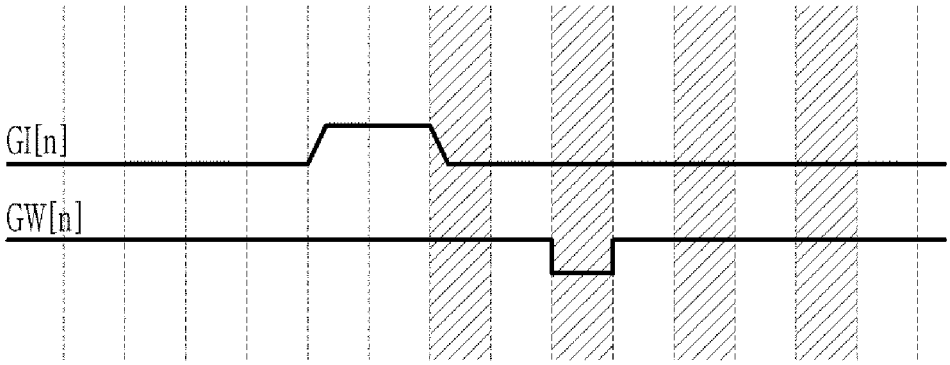

Not as in FIG. 3, signals such as in FIG. 15 and FIG. 16 may be applied to the light emitting display device having a connection structure of FIG. 14.

FIG. 15 and FIG. 16 are waveform diagrams of signals applied in the embodiment of FIG. 14.

The waveform diagram of FIG. 15 corresponds to the waveform diagram of FIG. 3, and FIG. 15 illustrates all waveforms applied in the embodiment of FIG. 14.

Compared to the waveform diagram of FIG. 3, in the waveform diagram of FIG. 15, a width of some sections is reduced to the half.

That is, in the waveform diagram of FIG. 15, a pre-bias and anode reset section and a gate and drain initialization section are respectively reduced to the width of 2 1Hs. In FIG. 15, the waveform needs to be applied only to the first scan signal GW [n], and thus there is no need of forming each section with a width of 4 1Hs as in FIG. 3.

The three features described with reference to FIG. 3 are all included in the embodiment of FIG. 15.

The first feature, that is, there are odd-numbered 1Hs positioned between the termination of the light emitting section and the pre-bias and anode reset section and the gate and drain initialization section, is illustrated in FIG. 15, and three 1Hs and seventh 1Hs are respectively positioned in FIG. 15.

Such a first feature causes timing with which the, light emission control signal EM[n] is changed and timing with which the second scan signal GC[n], the initialization control signal GI[n], or the bias control signal GB[n] is changed to be different from each other such that drawbacks such as decrease of the high level voltage value generated when performing with the same timing or causing a relatively significant change by influencing the peripheral signal with the same timing, and the like, may be eliminated.

Referring to FIG. 15, the second feature, that is, the section for initializing the gate electrode of the driving transistor T1 and the section for initializing the drain electrode of the driving transistor T are overlapped with each other, is illustrated. Referring to FIG. 15, the second scan signal GC[n] and the initialization control signal GI[n] are simultaneously changed to the high level with the same timing in the gate and drain initialization section (Gate & Drain Initial).

As described, the section during which the gate electrode of the driving transistor T1 is initialized and the section during which the drain electrode of the driving transistor is initialized are set to be overlapped with each other, the second scan signal GC[n] is not changed to the high level while the gate electrode of the driving transistor T1 is being initialized, and thus a change in an initialization voltage (first initialization voltage Vint1) of the gate electrode of the driving transistor T1 due to a voltage level change of the second scan signal GC[n] does not occur such that the voltage of the gate electrode of the driving transistor T1 becomes equal to the first initialization voltage Vint1.

Referring to FIG. 15, the third feature, that is, a section in which the first scan signal GW[n] is applied is set to be within the first application section (marked by slashes in FIG. 15) among the unit application sections, is illustrated in FIG. 15.

Such a feature relates to a section where the initialization control signal GI[n] is floated and this will be described in more detail with reference to FIG. 16.

Referring to FIG. 16, only the initialization control signal GI[n] and the first scan signal GW[n] of FIG. 15 are included.

The initialization control signal GI[n] shown in FIG. 16 includes a section where a voltage is applied and a section where the signal is floated, and a low level voltage is directly applied in the first application section (section marked by slashes) but the signal is floated in the second application section.

Therefore, although the first scan signal GW[n] is applied to the first application section and thus a voltage is changed, the initialization control signal GI[n] can be maintained with the low level voltage. When the first scan signal GW[n] is applied in the second application section, a voltage is changed according to a change in the first scan signal GW[n] because the initialization control signal GI[n] is in a floated state. Accordingly, the voltage change can be reduced by applying the first scan signal GW [n] in the first application section where the initialization control signal GI [n] directly receives the low level voltage.

In FIG. 15 and FIG. 16, it is illustrated that the first scan signal GW[n] is applied in a first section of the second unit application section among four unit application sections. In embodiments, the first scan signal GW [n] may be applied to other first application section marked with slashes.

In the embodiments of FIG. 15 and FIG. 16, the section where the first scan signal GW[n] can be applied may be (1+2n)-th H (here, n is a natural number) among the writing available section.

In the above, in description of the third feature, the effects have been described mainly focusing on floating of the initialization control signal GI[n]. Analogous features may be applicable to other signals. It is possible to apply the first scan signal GW [n] to a section where the voltage level change of the signal can be reduced.

While example embodiments been described, practical embodiments are not limited to the described embodiments. Practical embodiments are intended to cover various modifications and equivalent arrangements within the scope of the appended claims.

What is claimed is:

1. A display device comprising:

a light emitting diode;

a first transistor, wherein a drain electrode of the first transistor is electrically connected to the light emitting diode and is connected between the light emitting diode and a source electrode of the first transistor;

a data line for transmitting a data voltage;

a second transistor electrically connected between the data line and the source electrode of the first transistor;

a third transistor electrically connected between the drain electrode of the first transistor and a gate electrode of the first transistor; and a fourth transistor electrically connected between a first initialization voltage source and the gate electrode of the first transistor for initializing the gate electrode of the first transistor with a first initialization voltage, wherein the third transistor is off for a first period, is on for a second period immediately following the first period, and is off for a third period immediately following the second period, wherein the fourth transistor is off for a fourth period, is on for a fifth period immediately following the fourth period, and is off for a sixth period immediately following the fifth period, and wherein the second period overlaps the fifth period.

2. The display device of claim 1, wherein the light emitting diode emits light for a seventh period, and wherein an odd number of scan-signal lengths immediately follow the seventh period and immediately precede the second period.

3. The display device of claim 2, wherein the odd number of scan-signal lengths immediately follow the seventh period and immediately precede the fifth period.

4. The display device of claim 1, wherein a writing available period overlaps each of the second period and the sixth period, includes a first application period, and includes a second application period immediately following the first application period, and wherein the second transistor is on for the first application period and is off for the second application period.

5. The display device of claim 4, wherein a gate electrode of the fourth transistor receives an initialization control signal, wherein the initialization control signal controls the fourth transistor, and wherein the initialization control signal is floating for the second application period.

6. The display device of claim 1, further comprising:

a bias-voltage transistor, wherein a drain electrode of the bias-voltage transistor is electrically connected to the source electrode of the first transistor, wherein a source electrode of the bias-voltage transistor is electrically connected to a bias-voltage source, wherein the bias-voltage transistor is turned on according to a first frequency, wherein each of the third transistor and the fourth transistor is turned on according to a second frequency, and wherein the first frequency is higher than the second frequency.

7. The display device of claim 1, further comprising:

a first scan line electrically connected to a gate electrode of the second transistor;

a second scan line electrically connected to a gate electrode of the third transistor;

an initialization control line electrically connected to a gate electrode of the fourth transistor;

a bias-voltage transistor, wherein a drain electrode of the bias-voltage transistor is electrically connected to the source electrode of the first transistor, and wherein a source electrode of the bias-voltage transistor is electrically connected to a bias-voltage source; and a bias control line electrically connected to a gate electrode of the bias-voltage transistor, wherein each of the second scan line, the initialization control line, and the bias control line is electrically connected to pixels of two pixel rows, and wherein the first scan line is electrically connected to pixels of exactly one of the two pixel rows.

8. The display device of claim 7, further comprising:

a fifth transistor, wherein a source electrode of the fifth transistor is electrically connected to a driving-voltage source, and wherein a drain electrode of the fifth transistor is electrically connected to the source electrode of the first transistor;

a sixth transistor, wherein a source electrode of the sixth transistor is electrically connected to the drain electrode of the first transistor, and wherein a drain electrode of the sixth transistor is electrically connected to an anode of the light emitting diode;

a seventh transistor for initializing a voltage of the anode of the light emitting diode to a second initialization voltage, wherein a source electrode of the seventh transistor is electrically connected to a second initialization voltage source, and wherein a drain electrode of the seventh transistor is electrically connected to the anode of the light emitting diode; and a light emission control line electrically connected to each of a gate of the fifth transistor and a gate electrode of the sixth transistor, wherein a gate electrode of the seventh transistor is electrically connected to the bias control line.

9. A method of operating a display device that comprises a driving transistor, a light emitting diode, and a storage capacitor, the method comprising:

throughout a light emitting period, transmitting an output current through the driving transistor to the light emitting diode for the light emitting diode to emit light;

throughout a pre-bias period, applying a bias voltage to a source electrode of the driving transistor;

throughout an anode reset period, initializing an anode of the light emitting diode;

throughout a gate initialization period, initializing a gate electrode of the driving transistor;

throughout a drain initialization period, initializing a drain electrode of the driving transistor; and throughout a threshold voltage compensation and data writing period, compensating for a threshold voltage of the driving transistor, and writing a data voltage to the storage capacitor, wherein an odd number of scan-signal lengths immediately follow the light emitting period and immediately precede the drain initialization period.

10. The method of claim 9, wherein the odd number of scan-signal lengths immediately follow the light emitting period and immediately precede the gate initialization period.

11. The method of claim 10, wherein the drain initialization period and the gate initialization period at least partially overlap each other.

12. The method of claim 11, wherein the drain initialization period and the gate initialization period start simultaneously.

13. The method of claim 10, wherein a writing available period starts after the gate initialization period has ended, overlaps the drain initialization period, includes a first application period, and includes a second application period, wherein the compensating and the writing are performed for the first application period and not for the second application period, and wherein the threshold voltage compensation and data writing period is equivalent to one scan-signal length within the first application period.

14. The method of claim 13, further comprising:

providing an initialization control signal in the gate initialization period for controlling initialization of the gate electrode of the first transistor, wherein the initialization control signal is floating for the second application period.

15. The method of claim 9, wherein the light emitting period, the pre-bias period, and the anode reset period repeat according to a first frequency, wherein the gate initialization period, the drain initialization period, and the threshold voltage compensation and data writing period repeat according to a second frequency, and wherein the first frequency is higher than the second frequency.

16. A method of operating a display device that comprises a driving transistor, a light emitting diode, and a storage capacitor, the method comprising:

throughout a light emitting period, transmitting an output current through the driving transistor to the light emitting diode for the light emitting diode to emit light;

throughout a pre-bias period, applying a bias voltage to a source electrode of the driving transistor;

throughout an anode reset period, initializing an anode of the light emitting diode;

throughout a gate initialization period, initializing a gate electrode of the driving transistor;

throughout a drain initialization period, initializing a drain electrode of the driving transistor; and throughout a threshold voltage compensation and data writing period, compensating for a threshold voltage of the driving transistor, and writing a data voltage to the storage capacitor, wherein a writing available period includes a first application period and a second application period, and wherein the threshold voltage compensation and data writing period is within the first application period.

17. The method of claim 16, further comprising:

providing an initialization control signal in the gate initialization period for controlling initialization of the gate electrode of the first transistor, wherein the initialization control signal is floating for the second application period.

18. The method of claim 16, wherein an odd number of scan-signal lengths immediately precede the drain initialization period or the gate initialization period and immediately follow the light emitting period.

19. The method of claim 16, wherein the drain initialization period and the gate initialization period at least partially overlap each other.

20. The method of claim 16, wherein the light emitting period, the pre-bias period, and the anode reset period repeat according to a first frequency, wherein the gate initialization period, the drain initialization period, and the threshold voltage compensation and data writing period repeat according to a second frequency, and wherein the first frequency is higher than the second frequency.

* * * * *